US010397724B2

(12) United States Patent
Celestinos et al.

(10) Patent No.: US 10,397,724 B2
(45) Date of Patent: Aug. 27, 2019

(54) MODIFYING AN APPARENT ELEVATION OF A SOUND SOURCE UTILIZING SECOND-ORDER FILTER SECTIONS

(71) Applicant: Samsung Electronics Co., Ltd., Suwon-si, Gyeonggi-do (KR)

(72) Inventors: Adrian Celestinos, Sherman Oaks, CA (US); Allan Devantier, Newhall, CA (US); Elisabeth M. McMullin, Woodland Hills, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/936,118

(22) Filed: Mar. 26, 2018

(65) Prior Publication Data

US 2018/0279065 A1 Sep. 27, 2018

Related U.S. Application Data

(60) Provisional application No. 62/477,427, filed on Mar. 27, 2017, provisional application No. 62/542,276, filed on Aug. 7, 2017.

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 7/302* (2013.01);
(Continued)

(58) Field of Classification Search
None
See application file for complete search history.

(56) References Cited

U.S. PATENT DOCUMENTS 5,742,689 A * 4/1998 Tucker ..... H04S 3/004 381/17
8,612,187 B2 * 12/2013 Amadu ..... H04S 7/30 345/156

(Continued)

FOREIGN PATENT DOCUMENTS

JP 2004135023 A 4/2004
JP 5326332 B2 10/2013

(Continued)

OTHER PUBLICATIONS

McMullen, K. et al., "Subjective Selection of Head-Related Transfer Functions (HRTFs) based on Spectral Coloration and Interaural Time Differences (ITD) Cues," Audio Engineering Society (AES) 133rd Convention, Oct. 26-29, 2012, pp. 1-9, AES, San Francisco, United States.

(Continued)

*Primary Examiner* — Paul W Huber
(74) *Attorney, Agent, or Firm* — Sherman IP LLP; Kenneth L. Sherman; Hemavathy Perumal

(57) ABSTRACT

One embodiment provides a method comprising determining an actual elevation of a sound source. The actual elevation is indicative of a first location at which the sound source is physically located relative to a first listening reference point. The method further comprises determining a desired elevation for a portion of an audio signal. The desired elevation is indicative of a second location at which the portion of the audio signal is perceived to be physically located relative to the first listening reference point. The desired elevation is different from the actual elevation. The method further comprises, based on the actual elevation, the desired elevation and the first listening reference point, modifying the audio signal, such that the portion of the audio signal is perceived to be physically located at the desired (Continued)

elevation during reproduction of the audio signal via the sound source.

18 Claims, 21 Drawing Sheets

(52) U.S. Cl.
CPC ..... *H04S 2400/01* (2013.01); *H04S 2400/11* (2013.01); *H04S 2420/01* (2013.01); *H04S 2420/03* (2013.01)

(56) References Cited

U.S. PATENT DOCUMENTS

| | | | | |
|---|---|---|---|---|
| 9,396,731 | B2 | 7/2016 | Herre et al. | |
| 9,544,679 | B2 | 1/2017 | Trestain et al. | |
| 2008/0243278 | A1* | 10/2008 | Dalton | H04S 7/304 700/94 |
| 2010/0266133 | A1* | 10/2010 | Nakano | H04R 3/04 381/17 |
| 2012/0008789 | A1* | 1/2012 | Kim | H04S 3/002 381/17 |
| 2013/0202117 | A1* | 8/2013 | Brungart | H04R 5/04 381/17 |
| 2015/0010160 | A1* | 1/2015 | Udesen | H04R 25/70 381/60 |
| 2015/0078595 | A1 | 3/2015 | Shintani et al. | |
| 2015/0382127 | A1* | 12/2015 | Sun | H04S 7/30 381/17 |
| 2017/0325043 | A1* | 11/2017 | Jot | H04S 7/302 |
| 2018/0227695 | A1* | 8/2018 | Groh | H04S 7/302 |
| 2018/0262858 | A1* | 9/2018 | Noh | H04S 7/304 |

FOREIGN PATENT DOCUMENTS

| | | | |
|---|---|---|---|
| JP | 2015070324 | A | 4/2015 |
| JP | 5844995 | B2 | 1/2016 |
| JP | 6186627 | B2 | 8/2017 |
| KR | 1417065 | B1 | 7/2014 |
| WO | 2016-130834 | A1 | 8/2016 |

OTHER PUBLICATIONS

Lopez, J. J. et al., "Influence of the Listening Position in the Perception of Elevated Sources in Wave-Field Synthesis," in Audio Engineering Society Conference: 40th International Conference: Spatial Audio: Sense the Sound of Space, Oct. 2010, pp. 1-7, Tokyo, Japan.

Villegas, J. et al., "Improving Elevation Perception in Single-Layer Loudspeaker Array Display Using Equalizing Filters and Lateral Grouping," in Audio Engineering Society Convention 143, Paper 9868, Oct. 2017, AES, Japan {Abstract Only}.

Jot, J.M. et al., "Efficient Structures for Virtual Immersive Audio Processing," in Audio Engineering Society Convention 143, Paper 9865, Oct. 2017, pp. 1-8, AES, Japan.

Møller, H. et al., "Head-Related Transfer Functions of Human Subjects," J. Audio Eng. Soc, 43(5), pp. 300-321, May 1, 1995, AES, United States {Abstract Only}.

Blauert, J., "Spatial hearing—The psychophysics of human sound localization," The MIT Press, 1997 pp. 1-423, United States {Abstract Only}.

Ircam, "Listen HRTF Database," http://recherche.ircam.fr/equipes/salles/listen/index.html, 2002, [Online; accessed Jul. 19, 2017], 1 page.

Farina, A., "Simultaneous Measurement of Impulse Response and Distortion with a Swept-Sine Technique," in Audio Engineering Society Convention 108, Feb. 2000, pp. 1-24, United States.

Shaw, E. A. G., "The External Ear", In: Keidel W.D., Neff W.D. (eds) Auditory System, Handbook of Sensory Physiology, 1974, pp. 455-490, Springer Berlin Heidelberg, Berlin, Heidelberg, {Abstract Only}.

Ramos, G. et al., "Filter Design Method for Loudspeaker Equalization Based on IIR Parametric Filters," J. Audio Eng. Soc, pp. 1162-1178, Dec. 2006, 54(12), Spain {Abstract Only}.

* cited by examiner

61

60

62

64

63

65

93

94

95

96

97

98

99

MODIFYING AN APPARENT ELEVATION OF A SOUND SOURCE UTILIZING SECOND-ORDER FILTER SECTIONS

CROSS-REFERENCE TO RELATED APPLICATIONS

The present application claims priority to U.S. Provisional Patent Application No. 62/477,427, filed on Mar. 27, 2017, and U.S. Provisional Patent Application No. 62/542,276, filed on Aug. 7, 2017, which are both hereby incorporated by reference in their entireties.

TECHNICAL FIELD

One or more embodiments relate generally to loudspeakers and sound reproduction systems, and in particular, a system and method for modifying an apparent elevation of a sound source utilizing second-order filter sections.

BACKGROUND

A loudspeaker produces sound when connected to an integrated amplifier or an electronic device, such as a television (TV) set, a radio, a music player, an electronic sound producing device (e.g., a smartphone, a computer), a video player, or an LED screen.

SUMMARY

One embodiment provides a method comprising determining an actual elevation of a sound source. The actual elevation is indicative of a first location at which the sound source is physically located relative to a first listening reference point. The method further comprises determining a desired elevation for a portion of an audio signal. The desired elevation is indicative of a second location at which the portion of the audio signal is perceived to be physically located relative to the first listening reference point. The desired elevation is different from the actual elevation. The method further comprises, based on the actual elevation, the desired elevation and the first listening reference point, modifying the audio signal, such that the portion of the audio signal is perceived to be physically located at the desired elevation during reproduction of the audio signal via the sound source.

These and other features, aspects and advantages of the one or more embodiments will become understood with reference to the following description, appended claims, and accompanying figures.

DETAILED DESCRIPTION

Figure 1:
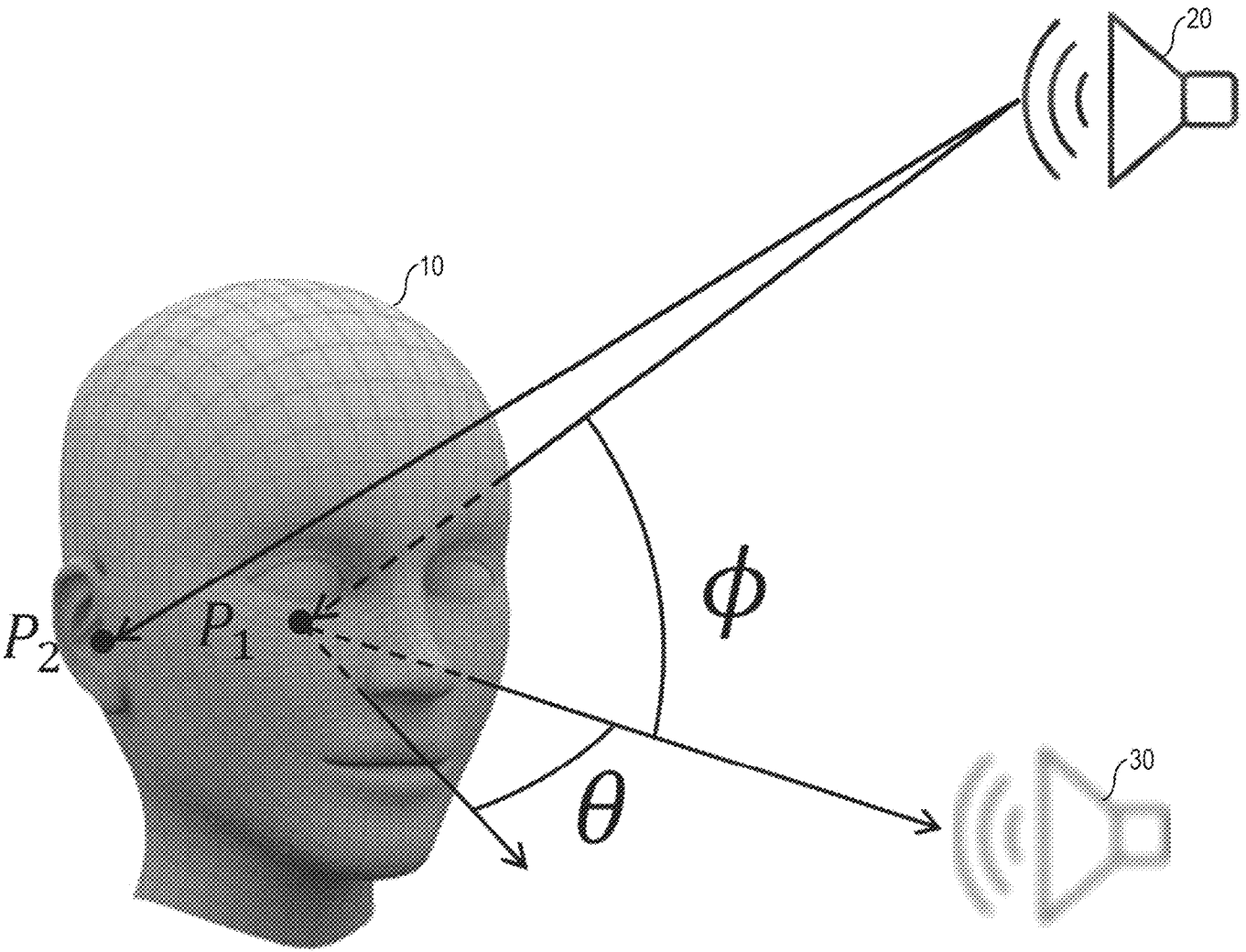
FIG. 1 illustrates sound localization from a perspective of a human subject.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers and sound reproduction systems, and in particular, a system and method for modifying an apparent elevation of a sound source utilizing second-order filter sections. One embodiment provides a method comprising determining an actual elevation of a sound source. The actual elevation is indicative of a first location at which the sound source is physically located relative to a first listening reference point. The method further comprises determining a desired elevation for a portion of an audio signal. The desired elevation is indicative of a second location at which the portion of the audio signal is perceived to be physically located relative to the first listening reference point. The desired elevation is different from the actual elevation. The method further comprises, based on the actual elevation, the desired elevation and the first listening reference point, modifying the audio signal, such that the portion of the audio signal is perceived to be physically located at the desired elevation during reproduction of the audio signal via the sound source.

For expository purposes, the term "sound source" as used in this specification generally refers to a system or a device for audio reproduction such as, but not limited to, a loudspeaker, a home theater loudspeaker system, a sound bar, a television, etc.

For expository purposes, the term "human subject" as used in this specification generally refers to an individual, such as a listener or a viewer of content.

For expository purposes, the terms "actual elevation", "actual sound source", "actual physical location" and "actual sound source location" as used in this specification generally refer to a physical location that a sound source reproducing an audio signal is positioned at.

For expository purposes, the terms "apparent elevation", "desired elevation", "apparent sound source", "apparent physical location" and "apparent sound source location" as used in this specification generally refer to a physical location that a human subject perceives a sound source reproducing an audio signal is positioned at.

For expository purposes, the terms "de-elevation" and "de-elevating" as used in this specification generally refer to a process of modifying an audio signal such that a portion of the audio signal is perceived by a human subject as reproduced by an apparent sound source that is located below an actual sound source reproducing the audio signal.

For expository purposes, the terms "elevation" and "elevating" as used in this specification generally refer to a process of modifying an audio signal such that a portion of the audio signal is perceived by a human subject as reproduced by an apparent sound source that is located above an actual sound source reproducing the audio signal.

For expository purposes, the term "digital filter" as used in this specification generally refers to a digital filter utilized in an electro-acoustic reproduction chain of a sound source and configured to modify an audio signal reproduced by the chain. Examples of digital filters include, but are not limited to, a de-elevation filter configured to modify an apparent elevation of a sound source via de-elevation, an elevation filter configured to modify an apparent elevation of a sound source via elevation, etc.

For expository purposes, the term "individual de-elevation filter" as used in this specification generally refers to a de-elevation filter customized or optimized for an individual human subject. For expository purposes, the term "individual elevation filter" as used in this specification generally refers to an elevation filter customized or optimized for an individual human subject. For expository purposes, the term "individual filter" as used in this specification generally refers to either an individual de-elevation filter or an individual elevation filter.

In movie and home theaters/cinemas, loudspeakers are typically positioned behind projection screens. If a projection screen is replaced with a LED screen, loudspeakers will need to be positioned either above or below the LED screen, resulting in an undesirable effect where a viewer of content displayed on the LED screen is able to discern that sound accompanying the content is reproduced from a sound source separate from the LED screen (i.e., from loudspeakers positioned above or below the LED screen).

One or more embodiments provide a system and a method for generating a digital filter configured to modify an audio signal by de-elevating or elevating a portion of the audio signal, such that the portion of the audio signal is perceived by a human subject as reproduced by an apparent sound source that is located above or below an actual sound source reproducing the audio signal. The digital filter is configured to modify the audio signal based on observed effects of de-elevation and elevation in human subjects in the frontal median plane.

In one embodiment, the digital filter is connected in an electro-acoustic reproduction chain of a sound source to generate a desired elevation for a portion of an audio signal, such that a human subject perceives the portion of the audio signal as reproduced by an apparent sound source that is located above or below an actual sound source reproducing the audio signal (i.e., the desired elevation is either above or below an actual elevation).

The digital filter may be utilized in environments where loudspeakers need to be positioned in physical locations that are different from an ideal/suitable physical location for correct sound reproduction (i.e., ideal placement). For example, the digital filter enables placement of loudspeakers at different physical locations, such as above or below an LED screen. The digital filter provides an improvement in integration of content (e.g., video, pictures/images) and sound.

In one embodiment, the digital filter is based on data collected during measurement sessions involving human subjects, wherein the data collected comprises Head-Related Transfer Functions (HRTFs) measurements. A HRTF is a transfer function that describes, for a particular angle of incidence ("incidence angle"), sound transmission from a free field to a point in the ear canal of a human subject. A generalized or universal HRTF relates to an average head, ears and torso measured across all human subjects based on individual transfer functions, where effects of de-elevation/elevation in the human subjects in the frontal median plane are isolated by extracting only transfer functions corresponding to an incidence angle in the frontal median plane.

In one embodiment, the digital filter comprises a set of second-order sections in cascade.

In one embodiment, to increase or maximize accuracy of an apparent elevation change resulting from de-elevation/elevation and to reduce or minimize spectral coloration (i.e., spectral balance), the digital filter may be enhanced or optimized based on evaluation data collected during a subjective evaluation with human subjects involving the digital filter.

In one embodiment, the digital filter may be implemented in devices and systems such as, but not limited to, LED screens (e.g., LED screens for movie theatres/cinemas), home theater loudspeaker systems, sound bars, televisions, etc.

In one embodiment, the digital filter may be used to improve three-dimensional (3D) sound reproduction in devices and systems such as, but not limited to, headphones, virtual reality (VR) headsets, etc. For example, the digital filter may be configured to format high audio channels in 3D sound reproduction as Dolby Atmos or other audio formats.

FIG. 1 illustrates sound localization from a perspective of a human subject 10. As sound reproduced by an actual sound source 20 travels to an ear drum of a human subject 10, transmission and perception of the sound is modified or filtered by diffractions and reflections from the head, the external ear (i.e., pinna) and the torso of the human subject 10. The human subject 10 is able to recognize the modification or filtering and determine a direction of the sound source (i.e., a direction that the sound source originates from).

A Head Related Impulse Response (HRIR) is an impulse response representing a modification in transmission and perception of a sound as the sound travels from a sound source to an ear drum of a test subject, wherein the modification is caused by diffractions and reflections from the head, the external ear (i.e., pinna) and the torso of the test subject. HRTF represents a frequency domain version of HRIR. A HRTF corresponding to a path of sound transmission ("sound transmission path") from a sound source in a free field to a point in the ear canal of a human subject 10 comprises directional information relating to the sound transmission path. For example, directional information included in an HRTF may comprise one or more cues for sound localization that enable the human subject 10 to localize sound reproduced by the sound source. For example, the directional information may include cues for sound localization in the horizontal plane, such as Interaural Time Differences (ITDs) representing time arrivals of the sound to the ears, Interaural Level Differences (ILDs) resulting from head shadowing, and spectral changes resulting from reflections and diffractions of the head, the external ear and the torso of the human subject 10.

As audio signals arriving at both ears of a human subject 10 are almost identical, sound localization in the frontal median plane (i.e., vertical localization) is different than sound localization in the horizontal plane (i.e., horizontal localization). Specifically, cues for sound localization in the frontal median plane may be reduced to monaural spectral stimuli. For example, localization blur for changes in elevation of a sound source in the forward direction is approximately 17 degrees (e.g., continuous speech by unfamiliar person).

Let $P_1$ denote a sound pressure at a center/middle position of the head of a human subject 10, $P_2$ denote a sound pressure at an entrance of a blocked ear canal of the human subject 10, $P_{2Left\ ear}$ denote a sound pressure at an entrance of a blocked left ear canal of the human subject 10, and $P_{2Right\ ear}$ denote a sound pressure at an entrance of a blocked right ear canal of the human subject 10. Let $\phi$ denote an elevation angle, and let $\theta$ denote an azimuth angle. Let $HRTF_{Left\ ear}(\phi, \theta)$ denote a HRTF corresponding to a sound transmission path from a sound source in the free field to the entrance of the blocked left ear canal of the human subject 10. $HRTF_{Left\ ear}(\phi, \theta)$ is represented in accordance with equation (1) provided below:

$$HRTF_{Left\ ear}(\phi, \theta) = \frac{P_{2_{Left\ ear}}}{P_1}(\phi, \theta). \tag{1}$$

Let $HRTF_{Right\ ear}(\phi, \theta)$ denote a HRTF corresponding to a sound transmission path from a sound source in the free field to the entrance of the blocked right ear canal of the human subject 10. $HRTF_{Right\ ear}(\phi, 0\theta)$ is represented in accordance with equation (2) provided below:

$$HRTF_{Right\ ear}(\phi, \theta) = \frac{P_{2_{Right\ ear}}}{P_1}(\phi, \theta). \tag{2}$$

Let $\phi_{apparent}$ denote a desired elevation (i.e., an apparent physical location that a human subject will perceive an apparent sound source 30 to be positioned), and let $\phi_{actual}$ denote an actual sound source location (i.e., a physical location of an actual sound source 20). Let $H_{de\text{-}el}(\phi_{apparent}, \phi_{actual})$ denote a de-elevation/elevation filter implemented for a sound source and defined by complex division in the frequency domain. A de-elevation/elevation filter $H_{de\text{-}el}(\phi_{apparent}, \phi_{actual})$ implemented for a sound source is represented in accordance with equation (3) provided below:

$$H_{de-el}(\phi_{apparent}, \phi_{actual}) = \frac{HRTF\ (\phi_{apparent})}{HRTF\ (\phi_{actual})}, \tag{3}$$

wherein HRTF $(\phi_{apparent})$ denotes a HRTF corresponding to a desired elevation $\phi_{apparent}$ of the sound source, and HRTF $(\phi_{actual})$ denotes a HRTF corresponding to an actual physical location $\phi_{actual}$ of the sound source. For all de-elevation/elevation filters implemented for a sound source, an azimuth angle $\theta$ is set to zero to correspond to frontal incidence direction.

Figure 2:
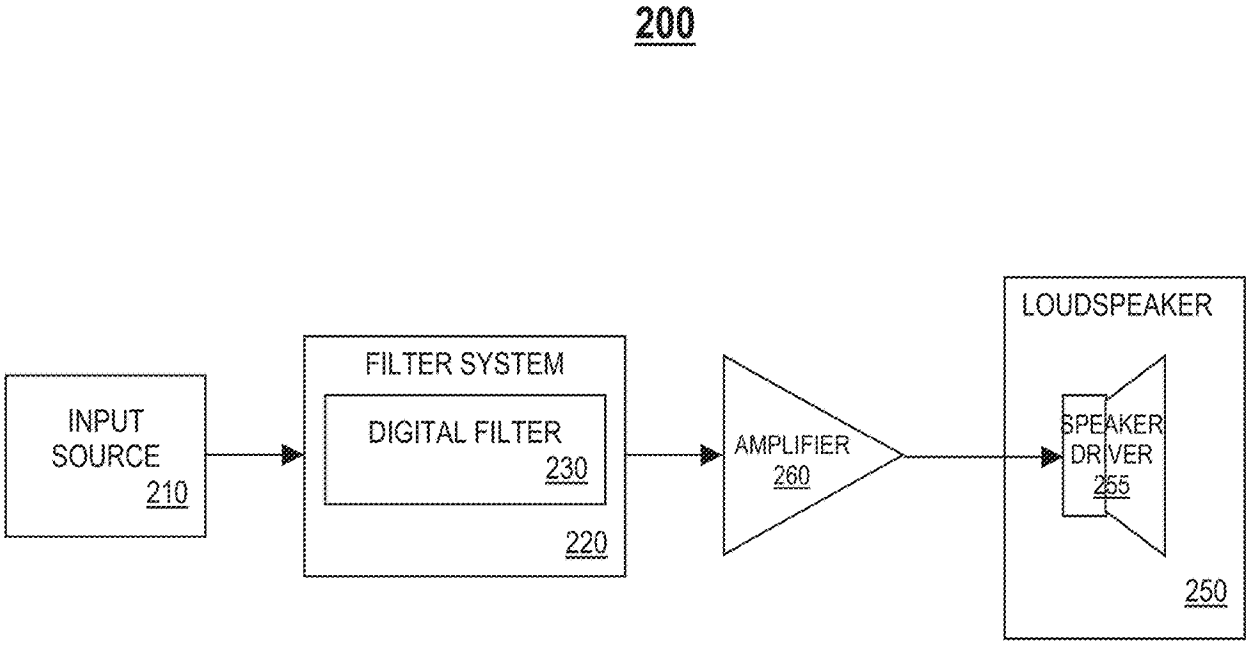
FIG. 2 illustrates an example loudspeaker system, in accordance with an embodiment.

FIG. 2 illustrates an example loudspeaker system 200, in accordance with an embodiment. The loudspeaker system 200 comprises a loudspeaker 250 including a speaker driver 255 for reproducing sound. The loudspeaker system 200 further comprises a filter system 220 including one or more digital filters 230. As described in detail later herein, each digital filter 230 is configured to: (1) receive, as input, an audio signal from an input source 210, and (2) modify the audio signal by de-elevating or elevating a portion of the audio signal, such that the portion of the audio signal is perceived by a human subject as reproduced by an apparent sound source that is located above or below the loudspeaker 250 reproducing the audio signal.

In one embodiment, the loudspeaker system 200 further comprises an amplifier 260 configured to amplify a modified audio signal received from the filter system 220.

In one embodiment, the filter system 220 is configured to receive an audio signal from different types of input sources 210. Examples of different types of input sources 210 include, but are not limited to, a mobile electronic device (e.g., a smartphone, a laptop, a tablet, etc.), a content playback device (e.g., a television, a radio, a computer, a music player such as a CD player, a video player such as a DVD player, a turntable, etc.), or an audio receiver, etc.

In one embodiment, the loudspeaker system 200 may be integrated in, but not limited to, one or more of the following: a computer, a smart device (e.g., smart TV), a subwoofer, wireless and portable speakers, car speakers, a movie theater/cinema, a LED screen (e.g., a LED screen for movie theatres/cinemas), a home theater loudspeaker system, a sound bar, etc.

Figure 3:
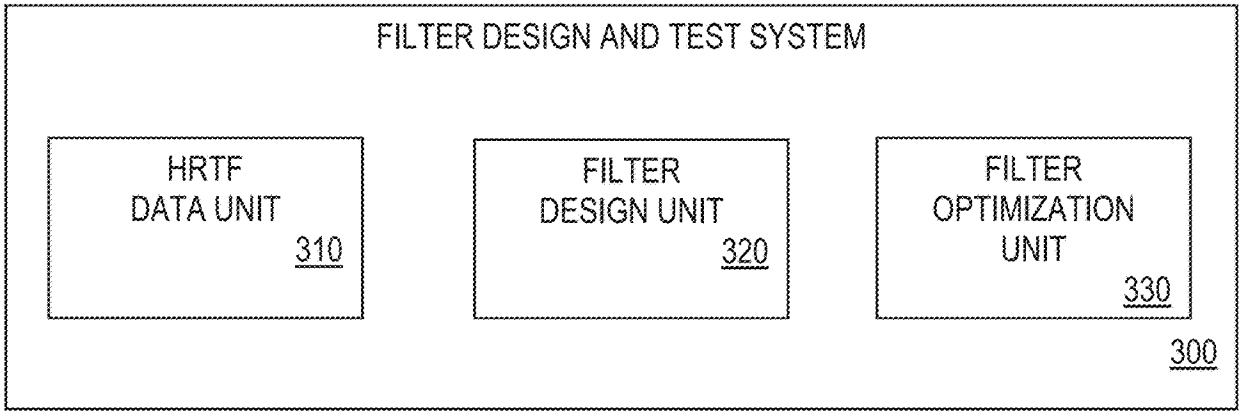
FIG. 3 illustrates an example filter design and test system for generating a digital filter utilized in the loudspeaker system, in accordance with an embodiment.

FIG. 3 illustrates an example filter design and test system 300 for generating a digital filter 230 utilized in the loudspeaker system 200, in accordance with an embodiment. In one embodiment, the filter design and test system 300 comprises a HRTF data unit 310 configured to maintain HRTF data comprising different collections of HRTF measurements collected during different measurement sessions involving test subjects.

In one embodiment, the HRTF data maintained by the HTRF data unit 310 is obtained from at least the following two databases: (1) an Institute for Research and Coordination in Acoustics/Music (IRCAM) database, and (2) a Samsung Audio Laboratory (SAL) database. Detailed information relating to a collection of HRTF measurements included in the IRCAM database may be found in the non-patent literature document titled "Listen HRTF Database", published by IRCAM in 2002, and available at http://recherche.ircam.fr/equipes/salles/listen/index.html.

The SAL database comprises a collection of HRTF measurements collected during a measurement session conducted in an anechoic chamber of SAL in Valencia, Calif. The measurement session involved test subjects that included fourteen human subjects and one dummy head. During the measurement session, HRIRs in the frontal median plane with a sound source positioned in a forward direction having a resolution of 5° from an elevation angle $\phi$ of substantially about 0° to an elevation angle $\phi$ of substantially about 60° were recorded. The HRIRs were recorded utilizing miniature microphones inserted at entrances of blocked left and right ear canals of the test subjects, and computed utilizing a logarithmic sweep algorithm. The sound source was a 2.5" full-range speaker driver mounted in a sealed spherical enclosure. The sound source was clamped to an automated arc connected to a turntable. A personal computer (PC) executing custom software controlled operation of the turntable, which in turn controlled upward and downward movement of the sound source.

Raw HRIR data collected during this same measurement session was pre-processed utilizing dedicated digital signal processing (DSP) audio hardware. Specifically, the raw HRIR data was truncated by multiplying the raw HRIR data with an asymmetric window formed by two half-sided Blackman-Harris windows, resulting in HRIRs with a final length of 256 samples. To obtain HRTFs, a discrete Fourier transform (DFT) was applied to HRIRs recorded at entrances of blocked left and right ear canals and centers of heads to transform the HRIRs to the frequency domain. A complex division in the frequency domain was applied to eliminate any effects of an electro-acoustic reproduction chain. To return the HRTFs to the time domain, an inverse Fourier transform was applied. The resulting HRIRs were low-pass filtered at substantially about 20 kHz and a direct current (DC) component was removed from the HRIRs.

A smoothing function was applied to each HRTF. For example, each HRTF was smoothed utilizing complex fractional octave smoothing.

As described in detail later herein, in one embodiment, the filter design and test system 300 comprises a filter design unit 320 configured to: (1) generate an individual filter for each test subject based on an analysis of the HRTF data, and (2) generate a universal average filter based on each individual filter for each test subject, wherein the universal average filter represents an average across all the test subjects.

For expository purposes, the term "dB average" as used in this specification generally refers to an average of multiple individual filters corresponding to multiple test subjects, wherein the average is obtained by averaging the multiple individual filters in dB.

In a preferred embodiment, a universal average filter generated by the filter design unit 320 is a parametric average across different test subjects, wherein the parametric average is obtained by averaging parametric values of parametric equalizers (PEQs) characterizing multiple individual filters corresponding to the test subjects. In another embodiment, a universal average filter generated by the filter design unit 320 is a dB average across different test subjects.

As described in detail later herein, in one embodiment, the filter design and test system 300 comprises a filter optimization unit 330 configured to perform a filter optimization process on a universal average filter generated by the filter design unit 320. In one example implementation, the filter optimization process involves optimizing the universal average filter to increase or maximize accuracy in apparent elevation change for as many human subjects as possible and reduce or minimize spectral coloration based on evaluation data collected during a subjective evaluation with human subjects involving the universal average filter. The resulting optimized universal average filter is an example digital filter 230 utilized in the filter system 220.

In one embodiment, a digital filter 230 generated by the filter design and test system 300 may be integrated in, but not limited to, one or more of the following: a computer, a smart device (e.g., smart TV), a subwoofer, wireless and portable speakers, car speakers, a movie theater/cinema, a LED screen (e.g., a LED screen for movie theatres/cinemas), a home theater loudspeaker system, a sound bar, etc.

Figure 4:
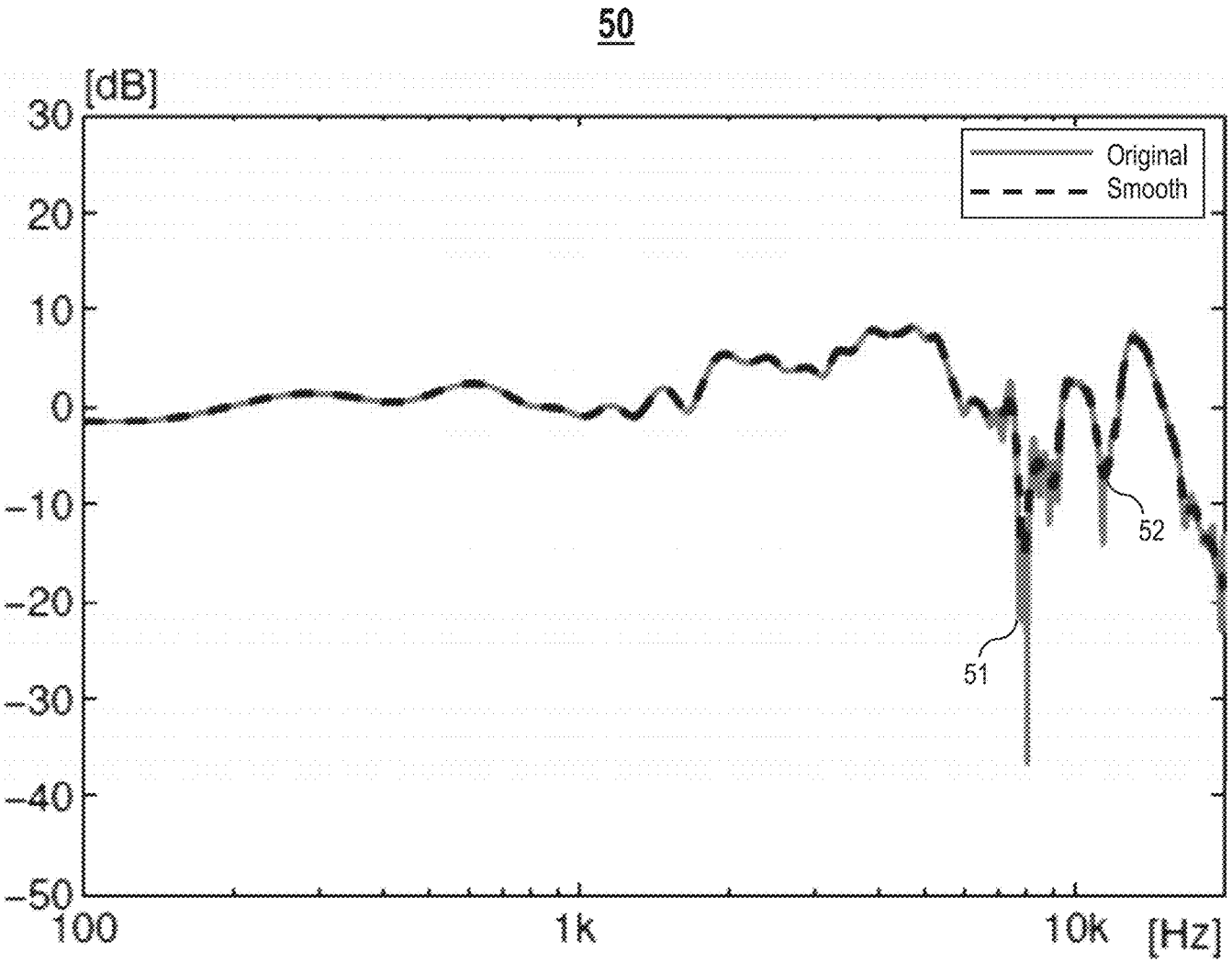
FIG. 4 is an example graph illustrating application of a smoothing function to a Head-Related Transfer Function (HRTF), in accordance with an embodiment.

FIG. 4 is an example graph 50 illustrating application of a smoothing function to a HRTF obtained during the measurement session conducted at SAL, in accordance with an embodiment. A horizontal axis of the graph 50 represents frequency in Hertz (Hz). A vertical axis of the graph 50 represents gain in decibels (dB). The graph 50 comprises each of the following: (1) a first curve 51 representing an original version of the HRTF, wherein the HRTF corresponds to a sound transmission path from the sound source utilized during the measurement session to a blocked left ear canal of a human subject involved in the measurement session, and the sound source is physically raised at an elevation angle ϕ of substantially about 10°, and (2) a second curve 52 representing a smoothed version of the HRTF. An amplitude and a phase of the original version of the HRTF was smoothed separately utilizing a 1/12 octave bandwidth filter and a rectangular window to smooth out high Q notches, resulting in the smoothed version of the HRTF.

Figure 5B:
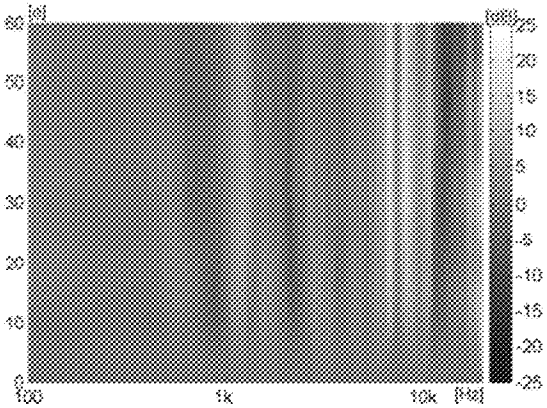
FIG. 5B is an example graph illustrating a HRTF normalized at an elevation angle for a second test subject.
Figure 5A:
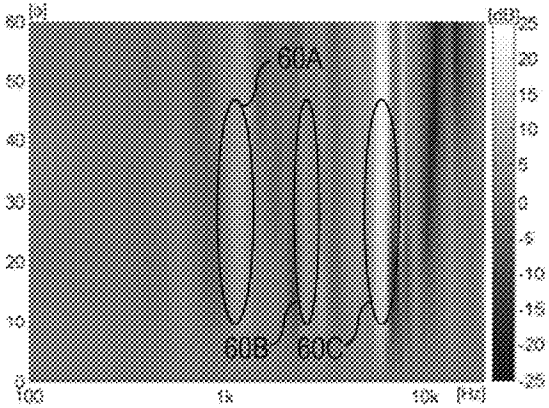
FIG. 5A is an example graph illustrating a HRTF normalized at an elevation angle for a first test subject.
Figure 5C:
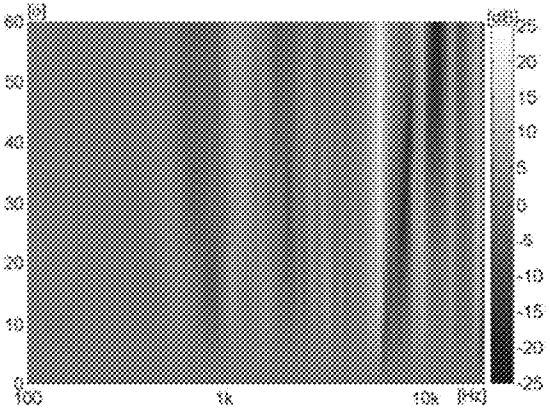
FIG. 5C is an example graph illustrating a HRTF normalized at an elevation angle for a third test subject.
Figure 5E:
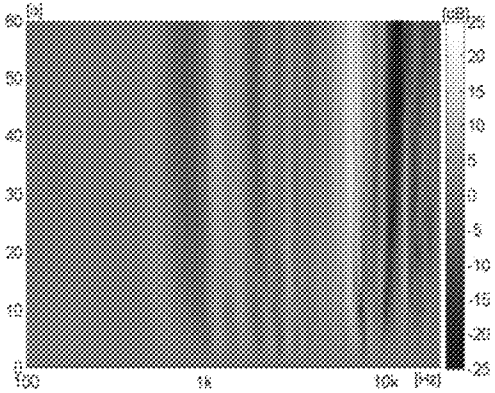
FIG. 5E is an example graph illustrating a HRTF normalized at an elevation angle for a fifth test subject.
Figure 5D:
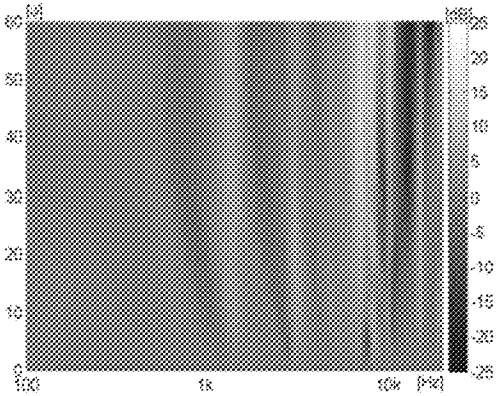
FIG. 5D is an example graph illustrating a HRTF normalized at an elevation angle for a fourth test subject.
Figure 5F:
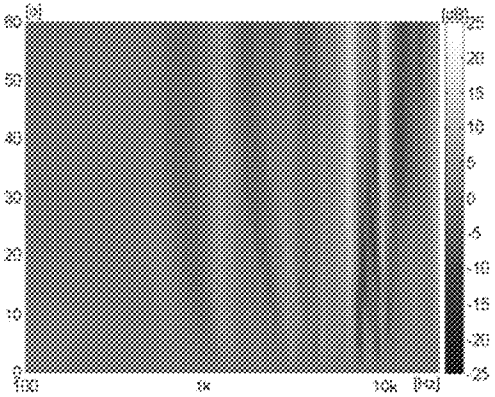
FIG. 5F is an example graph illustrating a HRTF normalized at an elevation angle for a sixth test subject.

FIGS. 5A-5F illustrate different HRTFs for different test subjects. Specifically, FIG. 5A is an example graph 60 illustrating a HRTF normalized at an elevation angle ϕ of substantially about 10° for a test subject referenced as "Subject 1018" in the IRCAM database. FIG. 5B is an example graph 61 illustrating a HRTF normalized at an elevation angle ϕ of substantially about 10° for a test subject referenced as "Subject 1020" in the IRCAM database. FIG. 5C is an example graph 62 illustrating a HRTF normalized at an elevation angle ϕ of substantially about 10° for a test subject referenced as "Subject 1041" in the IRCAM database. FIG. 5D is an example graph 63 illustrating a HRTF normalized at an elevation angle ϕ of substantially about 10° for a test subject referenced as "Subject 3" in the SAL database, in accordance with an embodiment. FIG. 5E is an example graph 64 illustrating a HRTF normalized at an elevation angle ϕ of substantially about 10° for a test subject referenced as "Subject 6" in the SAL database, in accordance with an embodiment. FIG. 5F is an example graph 65 illustrating a HRTF normalized at an elevation angle ϕ of substantially about 10° for a test subject referenced as "Subject 9" in the SAL database, in accordance with an embodiment. A horizontal axis of each graph 60-65 represents frequency in Hz. A right vertical axis of each graph 60-65 represents gain in dB. A left vertical axis of each graph 60-65 represents elevation angle ϕ in degrees (°).

The graphs 60-65 illustrate peaks and dips for the different test subjects (peaks are illustrated by white shaded areas and dips are illustrated by black shaded areas). For example, for each test subject referenced above in FIGS. 5A-5F, a first prominent (i.e., obvious) peak occurs at substantially about 1.25 kHz as the elevation angle ϕ increases (the first prominent peak is highlighted using reference label 60A in FIG. 5A). For all test subjects referenced above, a second prominent peak occurs at substantially about 6.5 kHz as the elevation angle ϕ increases (the second prominent peak is highlighted using reference label 60C in FIG. 5A). For all test subjects referenced above, another peak occurs at substantially about 2.8-3.2 kHz as the elevation angle ϕ increases, but this peak is not very clear (i.e., not as prominent as the two peaks described above) (this peak is highlighted using reference label 60B in FIG. 5A).

Based on the different HRTFs for the different test subject, the following inferences can be made with respect to de-elevating/elevating an apparent sound source at a desired elevation (e.g., de-elevating at an elevation angle ϕ of substantially about 25°): (1) one or more effects resulting from de-elevating/elevating the apparent sound source at the desired elevation must be removed or canceled, and (2) one or more spectral cues corresponding to the desired elevation must be factored into account. The filter design and test system 300 is configured to generate a digital filter 230 based on these inferences.

In one embodiment, the filter design unit 320 is configured to generate an individual filter for each test subject in accordance with equation (3) as provided above. As stated above, vertical localization (i.e., sound localization in the frontal median plane) relies mostly on monaural spectral cues. In one example implementation, the filter design unit 320 is configured to average individual filters corresponding to blocked left and right ear canals of a test subject to generate a monaural filter for the test subject.

In one embodiment, the filter and design system 300 generates a digital filter 230 as an infinite impulse response (IIR) filter, thereby allowing the digital filter 230 to be modified parametrically for different purposes. For example, the filter design unit 320 may generate an individual filter for each test subject as an IIR filter. In another embodiment, the filter and design system 300 generates a digital filter 230 as a minimum phase finite impulse response (FIR) filter.

Figure 6:
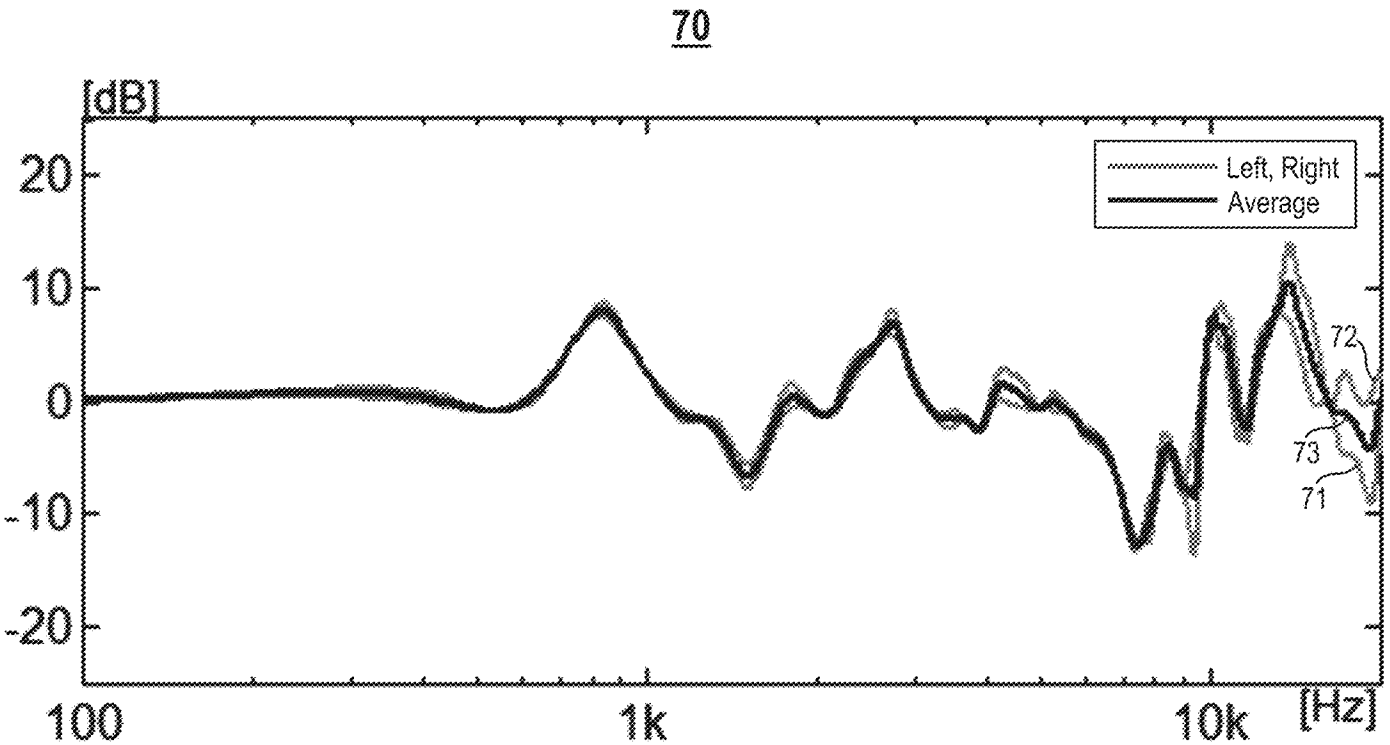
FIG. 6 is an example graph illustrating individual de-elevation filters generated by the filter and design test system for a test subject, in accordance with an embodiment.

FIG. 6 is an example graph 70 illustrating individual de-elevation filters generated by the filter and design test system 300 for a test subject referenced as "Subject 2" in the SAL database, in accordance with an embodiment. A horizontal axis of the graph 70 represents frequency in Hz. A vertical axis of the graph 70 represents gain in dB. The graph 70 comprises each of the following: (1) a first curve 71 representing a first individual de-evaluation filter corresponding to a blocked left ear canal of Subject 2, (2) a second curve 72 representing a second individual de-evaluation filter corresponding to a blocked right ear canal of Subject 2, and (3) a third curve 73 representing a monaural filter that is obtained by averaging the first curve 71 and the second curve 72 in dB.

In one embodiment, to obtain a proper average of multiple individual filters corresponding to multiple test subjects, the filter design unit 320 generates, for each test subject, a corresponding individual filter characterized (i.e., approximated) by a number PEQs. A universal average filter that is based on individual filters characterized by PEQs is more effective for more test subjects. In one embodiment, each individual filter generated by the filter design unit 320 is characterized by a set of second-order sections (i.e., biquads) in cascade. In one example implementation, an individual de-elevation filter corresponding a test subject is characterized by fourteen biquads in cascade.

In one example implementation, the filter design unit 320 is configured to perform, for each test subject, a filter conversion process for converting an individual filter corresponding to the test subject from its original magnitude into a number of second-order sections (e.g., 20 biquads) in cascade. The filter conversion process comprises: (1) inverting a magnitude response of the individual filter, and setting a flat target of 0 dB in the frequency range of 20 Hz to 20 kHz, and (2) applying a constrained brute force (CBF) algorithm to minimize error between the flat target and the inverted magnitude response.

Figure 7A:
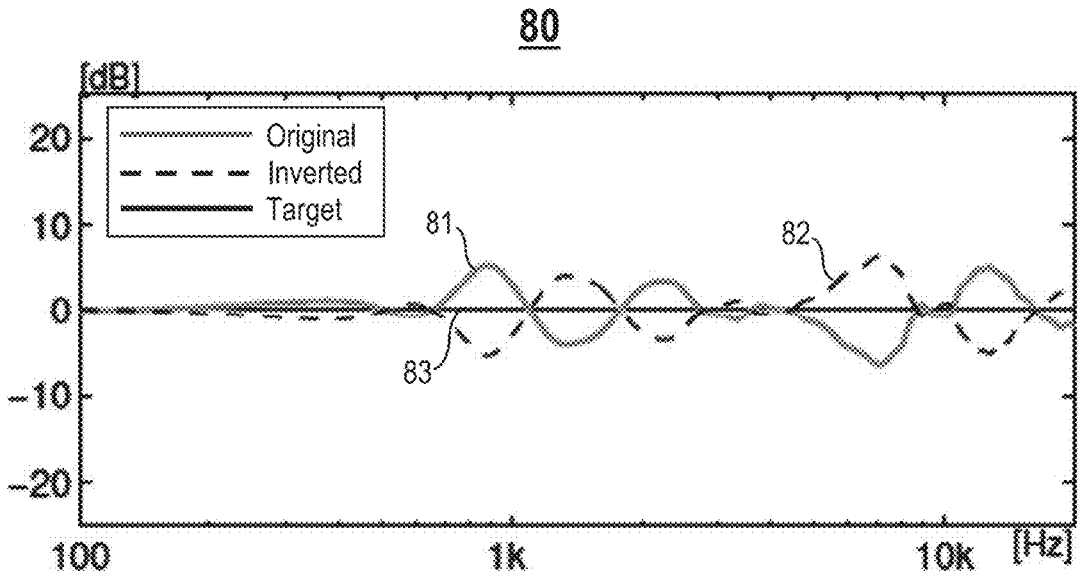
FIG. 7A is an example graph illustrating an original magnitude response and an inverted magnitude response of the individual de-elevation filter, in accordance with one embodiment.
Figure 7B:
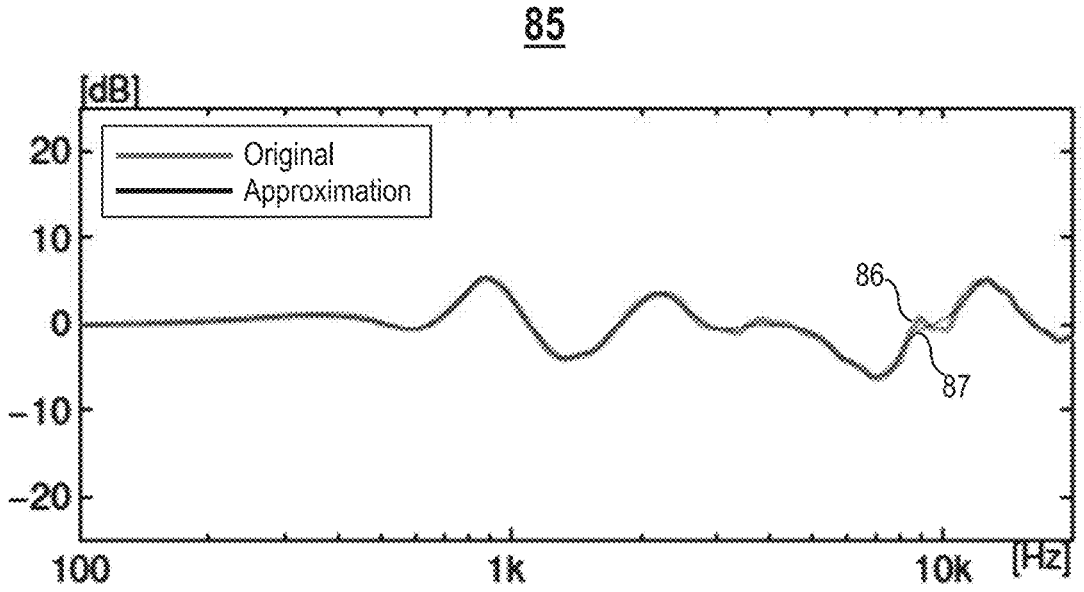
FIG. 7B is an example graph illustrating the original magnitude response of the individual de-elevation filter and an approximation of the filter with biquads, in accordance with an embodiment.

FIGS. 7A-7B illustrate an example filter conversion process performed on an individual de-elevation filter corresponding to a test subject referenced in the SAL database, in accordance with one embodiment. Specifically, FIG. 7A is an example graph 80 illustrating an original magnitude response and an inverted magnitude response of the individual de-elevation filter, in accordance with one embodiment. A horizontal axis of the graph 80 represents frequency in Hz. A vertical axis of the graph 80 represents gain in dB. The graph 80 comprises each of the following: (1) a first curve 81 representing the original magnitude response of the individual de-elevation filter, wherein the filter is set to create an apparent sound source at 0° by de-elevating the apparent sound source from an actual sound source physically raised at an elevation angle $\phi$ of substantially about 26°, (2) a second curve 82 representing an inverted magnitude response of the individual de-elevation filter, and (3) a horizontal line 83 representing a flat target of 0 dB extending between the frequency range of 20 Hz to 20 kHz.

FIG. 7B is an example graph 85 illustrating the original magnitude response of the individual de-elevation filter and an approximation of the filter with biquads, in accordance with an embodiment. A horizontal axis of the graph 85 represents frequency in Hz. A vertical axis of the graph 86 represents gain in dB. The graph 85 comprises each of the following: (1) a first curve 86 representing the original magnitude response of the individual de-elevation filter, and (2) a second curve 87 representing the approximation with twenty biquads in cascade.

Figure 8A:
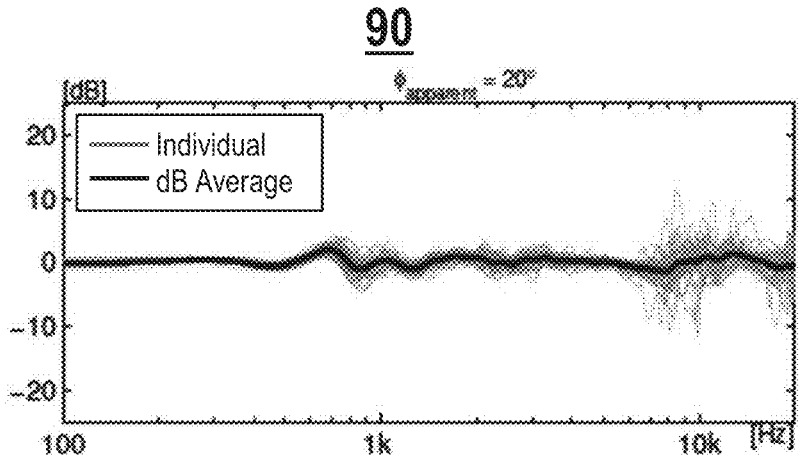
FIG. 8A is an example graph illustrating a first set of individual de-elevation filters set to create an apparent sound source at a first desired elevation angle and a dB average of the filters.
Figure 8B:
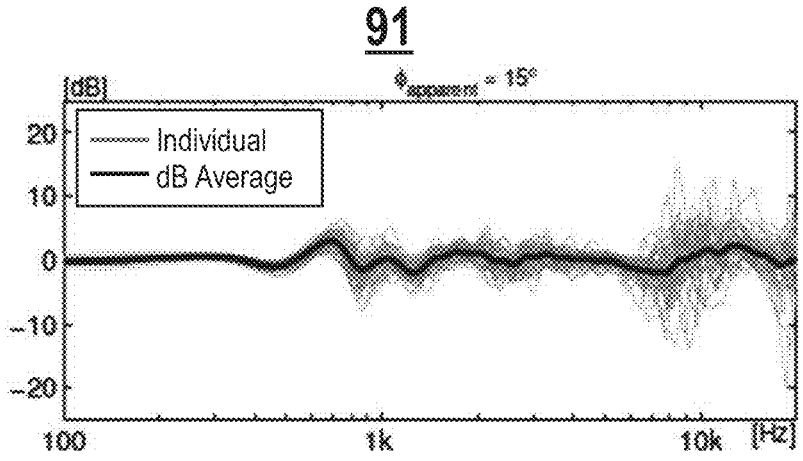
FIG. 8B is an example graph illustrating a second set of individual de-elevation filters set to create an apparent sound source at a second desired elevation angle and a dB average of the filters.
Figure 8C:
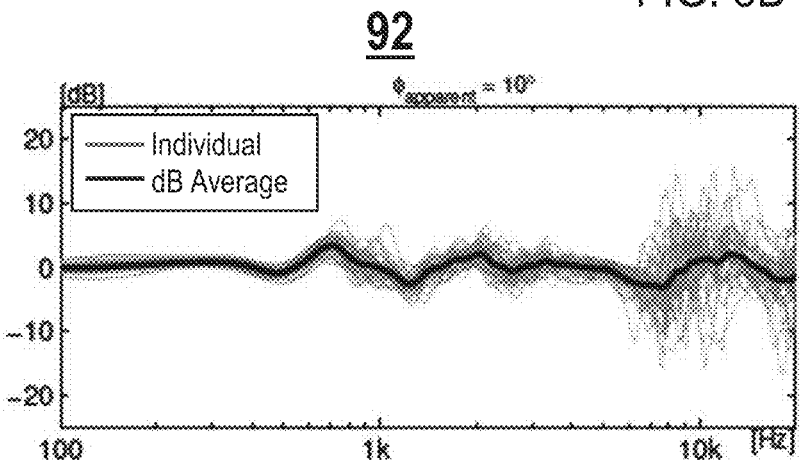
FIG. 8C is an example graph illustrating a third set of individual de-elevation filters set to create an apparent sound source at a third desired elevation angle and a dB average of the filters.
Figure 8D:
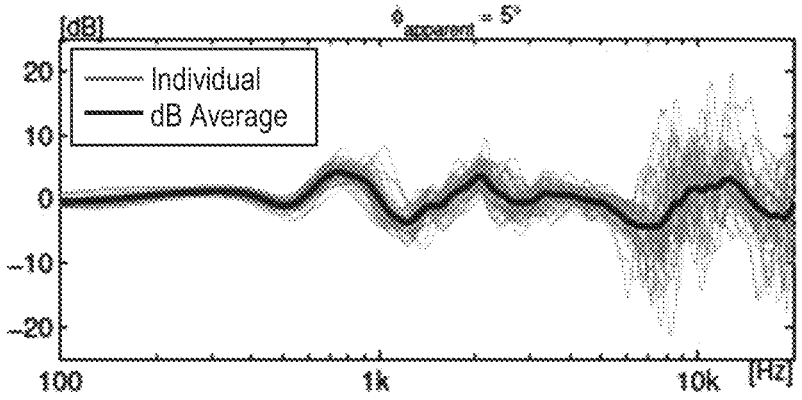
FIG. 8D is an example graph illustrating a fourth set of individual de-elevation filters set to create an apparent sound source at a fourth desired elevation angle and a dB average of the filters.
Figure 8E:
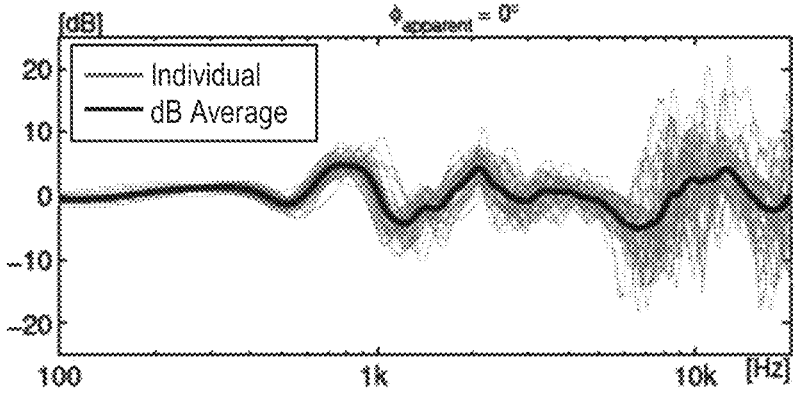
FIG. 8E is an example graph illustrating a fifth set of individual de-elevation filters set to create an apparent sound source at a fifth desired elevation angle and a dB average of the filters.

FIGS. 8A-8J each illustrate individual de-elevation filters for multiple test subjects and a dB average of the filters. Specifically, FIG. 8A is an example graph 90 illustrating individual de-elevation filters corresponding to multiple test subjects referenced in the IRCAM database and a dB average of the filters, wherein each individual de-elevation filter is set to create an apparent sound source at a desired elevation angle $\phi_{apparent}$ of substantially about 20°. FIG. 8B is an example graph 91 illustrating individual de-elevation filters corresponding to multiple test subjects referenced in the IRCAM database and a dB average of the filters, wherein each individual de-elevation filter is set to create an apparent sound source at a desired elevation angle $\phi_{apparent}$ of substantially about 15°. FIG. 8C is an example graph 92 illustrating individual de-elevation filters corresponding to multiple test subjects referenced in the IRCAM database and a dB average of the filters, wherein each individual de-elevation filter is set to create an apparent sound source at a desired elevation angle $\phi_{apparent}$ of substantially about 10°. FIG. 8D is an example graph 93 illustrating individual de-elevation filters corresponding to multiple test subjects referenced in the IRCAM database and a dB average of the filters, wherein each individual de-elevation filter is set to create an apparent sound source at a desired elevation angle $\phi_{apparent}$ of substantially about 5°. FIG. 8E is an example graph 94 illustrating individual de-elevation filters corresponding to multiple test subjects referenced in the IRCAM database and a dB average of the filters, wherein each individual de-elevation filter is set to create an apparent sound source at a desired elevation angle $\phi_{apparent}$ of substantially about 0°.

A horizontal axis of each graph 90-94 represents frequency in Hz. A vertical axis of each graph 90-94 represents gain in dB. Each graph 90-94 comprises each of the following: (1) multiple gray curves, wherein each gray curve represents an individual de-elevation filter corresponding to a test subject referenced in the IRCAM database, and (2) a single black curve representing a dB average of all individual de-elevation filters represented by the gray curves.

Figure 8F:
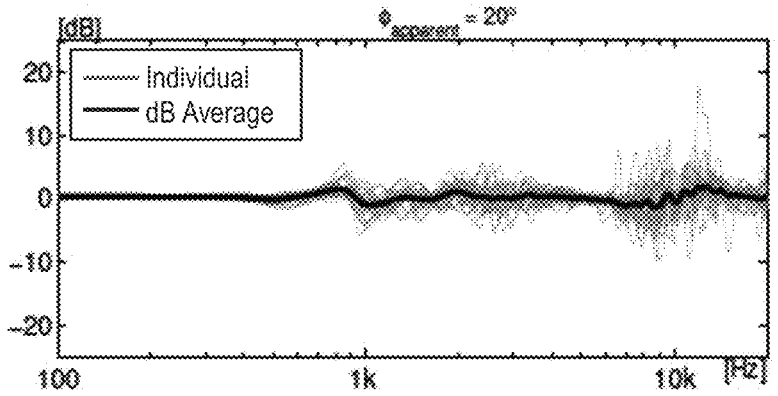
FIG. 8F is an example graph illustrating a sixth set of individual de-elevation filters set to create an apparent sound source at the first desired elevation angle and a dB average of the filters, in accordance with an embodiment.
Figure 8G:
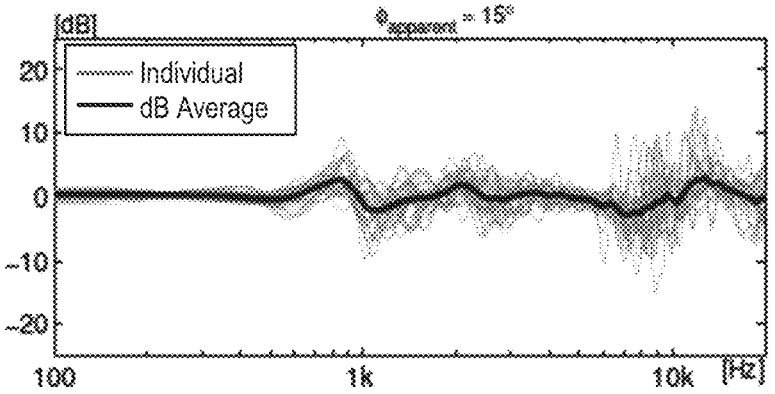
FIG. 8G is an example graph illustrating a seventh set of individual de-elevation filters set to create an apparent sound source at the second desired elevation angle and a dB average of the filters, in accordance with an embodiment.
Figure 8H:
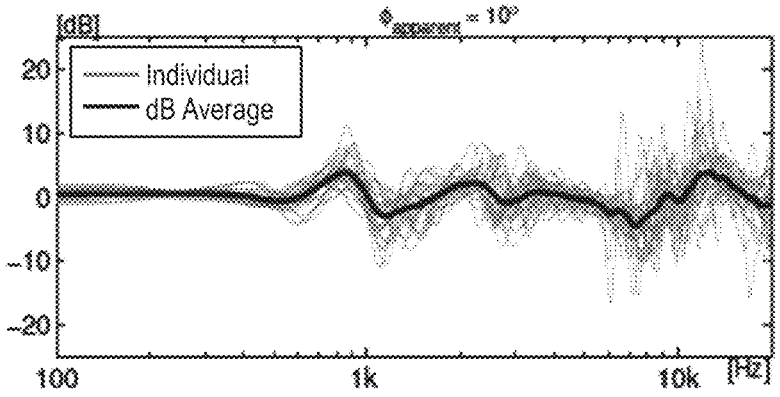
FIG. 8H is an example graph illustrating an eight set of individual de-elevation filters set to create an apparent sound source at the third desired elevation angle and a dB average of the filters, in accordance with an embodiment.
Figure 8I:
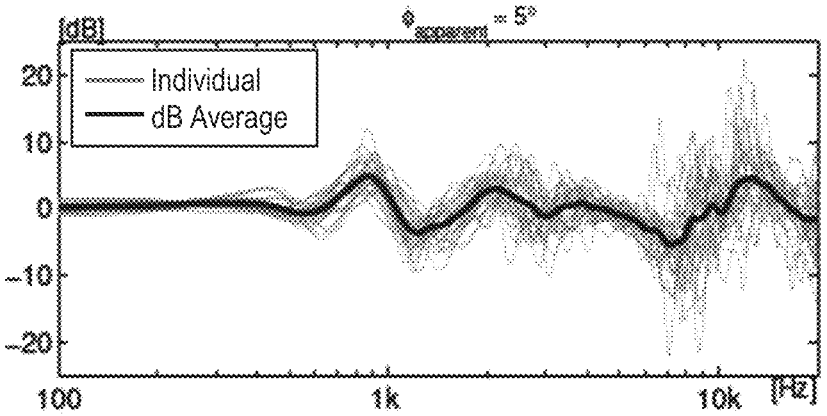
FIG. 8I is an example graph illustrating a ninth set of individual de-elevation filters set to create an apparent sound source at the fourth desired elevation angle and a dB average of the filters, in accordance with an embodiment.
Figure 8J:
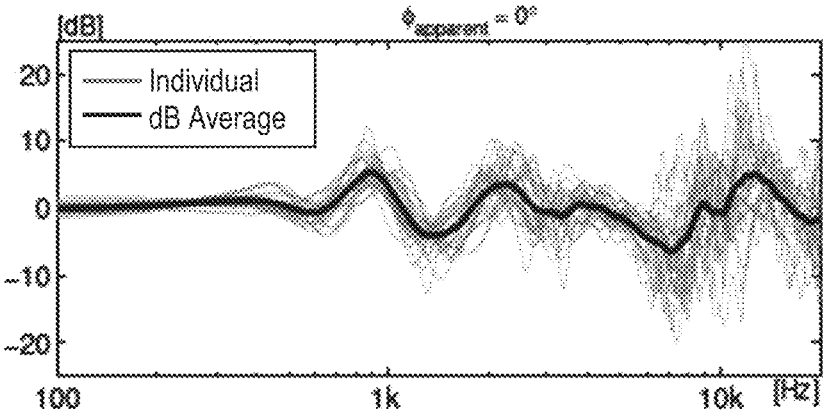
FIG. 8J is an example graph illustrating a tenth set of individual de-elevation filters set to create an apparent sound source at the fifth desired elevation angle and a dB average of the filters, in accordance with an embodiment.

FIG. 8F is an example graph 95 illustrating individual de-elevation filters corresponding to multiple test subjects referenced in the SAL database and an average of the individual de-elevation filters, wherein each individual de-elevation filter is set to create an apparent sound source at a desired elevation angle $\phi_{apparent}$ of substantially about 20°. FIG. 8G is an example graph 96 illustrating individual de-elevation filters corresponding to multiple test subjects referenced in the SAL database and an average of the individual de-elevation filters, wherein each individual de-elevation filter is set to create an apparent sound source at a desired elevation angle $\phi_{apparent}$ of substantially about 15°. FIG. 8H is an example graph 97 illustrating individual de-elevation filters corresponding to multiple test subjects referenced in the SAL database and an average of the individual de-elevation filters, wherein each individual de-elevation filter is set to create an apparent sound source at a desired elevation angle $\phi_{apparent}$ of substantially about 10°. FIG. 8I is an example graph 98 illustrating individual de-elevation filters corresponding to multiple test subjects referenced in the SAL database and an average of the individual de-elevation filters, wherein each individual de-elevation filter is set to create an apparent sound source at a desired elevation angle $\phi_{apparent}$ of substantially about 5°. FIG. 8J is an example graph 99 illustrating individual de-elevation filters corresponding to multiple test subjects referenced in the SAL database and an average of the individual de-elevation filters, wherein each individual de-elevation filter is set to create an apparent sound source at a desired elevation angle $\phi_{apparent}$ of substantially about 0°.

A horizontal axis of each graph 95-99 represents frequency in Hz. A vertical axis of each graph 95-99 represents gain in dB. Each graph 95-99 comprises each of the following: (1) multiple gray curves, wherein each gray curve represents an individual de-elevation filter corresponding to a test subject referenced in the SAL database, and (2) a single black curve representing a dB average of all individual de-elevation filters represented by the gray curves.

The different individual de-elevation filters shown in FIGS. 8A-8J have common shapes below 4000 Hz, but deviate in shape at higher frequencies.

In one embodiment, the filter design unit 320 is configured to apply a pattern recognition algorithm to each individual filter for each test subject to determine one or more peaks and one or more dips of the filter, and parametric values associated with the peaks and dips, such as a width of each peak/dip, an amplitude (i.e., height) of each peak/dip, and a frequency at which each peak/dip occurs. The parametric values determined are used to generate parametric information defining a number of PEQs that characterize (i.e., approximate) the filter.

In one embodiment, the filter design unit 320 maintains, for each test subject, parametric information defining a number of PEQs (e.g., 14 PEQs) that characterize an individual filter corresponding to the test subject. Table 1 below provides example parametric information defining 14 PEQs that characterize an individual de-elevation filter corresponding to a test subject referenced as "Subject 2" in the SAL database. As shown in Table 1, the example parametric information comprises, for each of the 14 PEQs, corresponding parametric values such as a corresponding frequency, a corresponding gain, and a corresponding Q.

TABLE 1

| PEQ | Frequency (Hz) | Gain (dB) | Q |
|---|---|---|---|
| 1 | 260.86 | 0.73 | 1.06 |
| 2 | 546.44 | −2.08 | 3.14 |
| 3 | 824.09 | 8.87 | 3.64 |
| 4 | 1475.9 | −7.04 | 4.38 |
| 5 | 2682.72 | 7.67 | 5.42 |
| 6 | 3585.32 | −3.14 | 3.23 |
| 7 | 4343.61 | 2.71 | 9.01 |
| 8 | 6309.63 | 0.99 | 1.12 |
| 9 | 7465.18 | −14.07 | 4.02 |
| 10 | 9331.71 | −10.23 | 10.17 |
| 11 | 10239.95 | 9.86 | 6.92 |
| 12 | 11578.98 | −6.96 | 10.92 |
| 13 | 13732 | 10.98 | 2.74 |
| 14 | 18845.08 | −4.22 | 1.37 |

Figure 9:
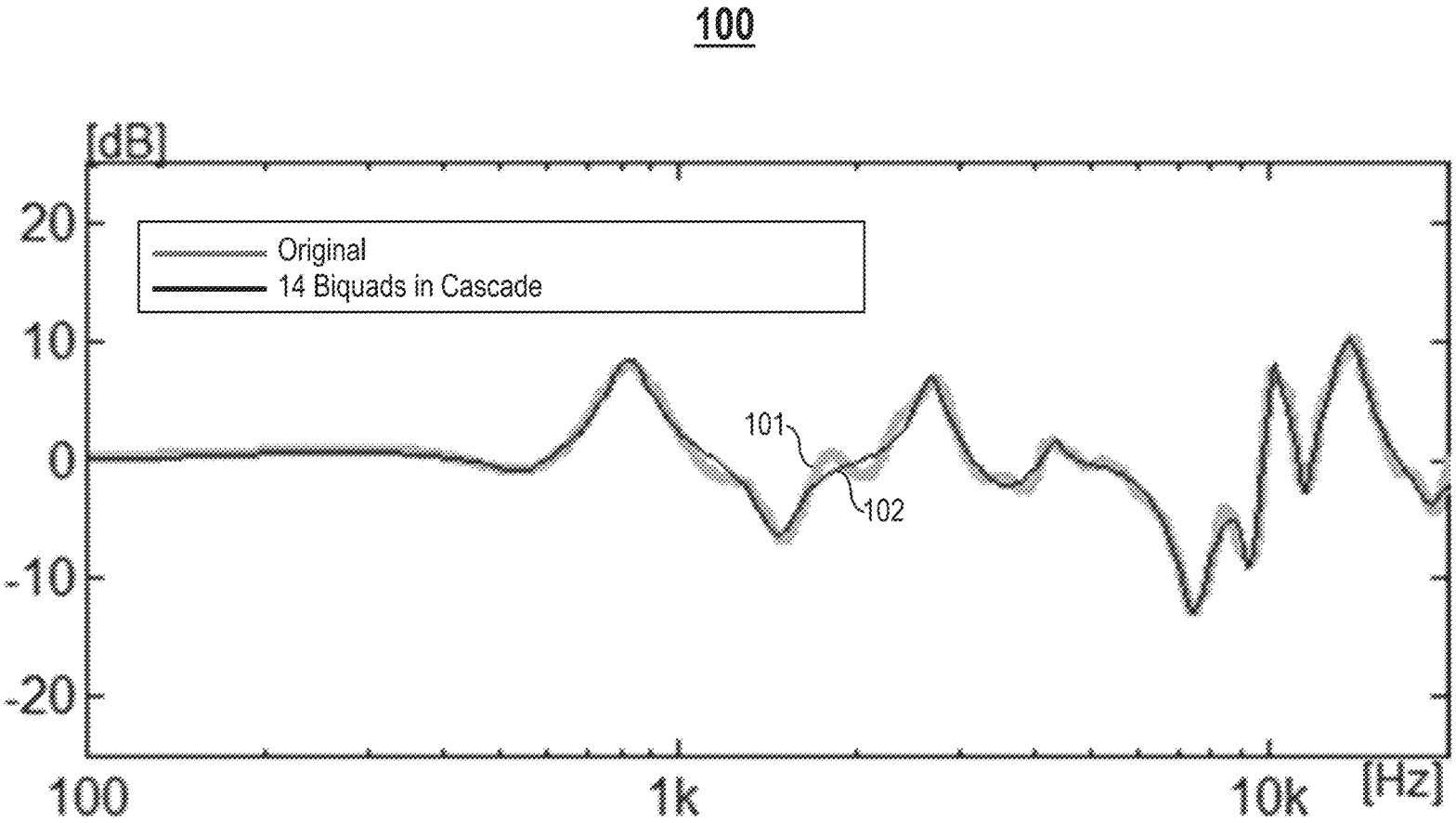
FIG. 9 is an example graph illustrating an individual de-elevation filter corresponding to a test subject and an approximation of the filter with biquads, in accordance with an embodiment.

FIG. 9 is an example graph 100 illustrating an individual de-elevation filter corresponding to a test subject referenced as "Subject 2" in the SAL database and an approximation of the filter with biquads, in accordance with an embodiment. A horizontal axis of the graph 100 represents frequency in Hz. A vertical axis of the graph 100 represents gain in dB. The graph 100 comprises each of the following: (1) a first curve 101 representing the individual de-elevation filter, and (2) a second curve 102 representing the approximation with fourteen biquads in cascade, wherein the approximation is based on parametric information included in Table 1 as provided above. For each of the 14 PEQs listed in Table 1 above, a corresponding frequency and a corresponding gain for the PEQ are plotted along the second curve 102.

Figure 10A:
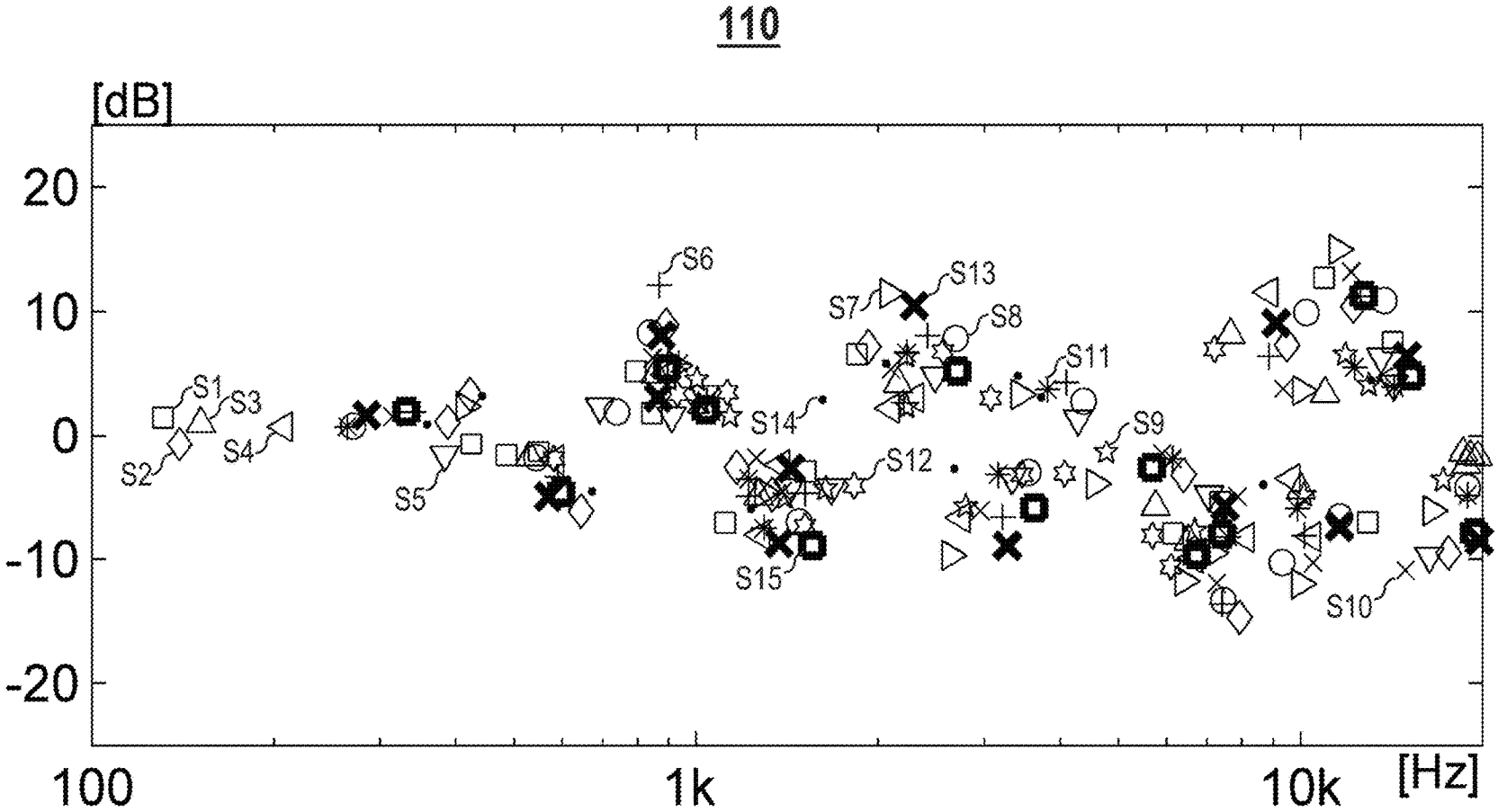
FIG. 10A is an example graph illustrating data points representing gains and frequencies of multiple parametric equalizers (PEQs), in accordance with an embodiment.

FIG. 10A is an example graph 110 illustrating data points representing gains and frequencies of multiple PEQs, in accordance with an embodiment. A horizontal axis of the graph 110 represents frequency in Hz. A vertical axis of the graph 110 represents gain in dB. The graph 110 comprises each of the following: (1) a first set of data points with marker symbols referenced using reference label S1, (2) a second set of data points with marker symbols referenced using reference label S2, (3) a third set of data points with marker symbols referenced using reference label S3, (4) a fourth set of data points with marker symbols referenced using reference label S4, (5) a fifth set of data points with marker symbols referenced using reference label S5, (6) a sixth set of data points with marker symbols referenced using reference label S6, (7) a seventh set of data points with marker symbols referenced using reference label S7, (8) an eighth set of data points with marker symbols referenced using reference label S8, (9) a ninth set of data points with marker symbols referenced using reference label S9, (10) a tenth set of data points with marker symbols referenced using reference label S10, (11) an eleventh set of data points with marker symbols referenced using reference label S11, (12) a twelfth set of data points with marker symbols referenced using reference label S12, (13) a thirteenth set of data points with marker symbols referenced using reference label S13, (14) a fourteenth set of data points with marker symbols referenced using reference label S14, and (15) a fifteenth set of data points with marker symbols referenced using reference label S15.

Each set of data points illustrated in the graph 110 corresponds to a test subject referenced in the SAL database. For each set of data points, each data point of the set corresponds to one of a number of PEQs used to characterize an individual de-elevation filter for a corresponding test subject, and represents a corresponding gain and a corresponding frequency of the corresponding PEQ. In one example implementation, each set of data points illustrated in the graph 110 comprises fourteen data points, and each data point of the set corresponds to one of fourteen PEQs used to characterize an individual de-elevation filter for a corresponding test subject.

The data points illustrated in the graph 110 may be grouped (i.e., clustered) into different groups (i.e., clusters), such that common PEQs corresponding to different test subjects but with similar gains may be grouped together.

Figure 10B:
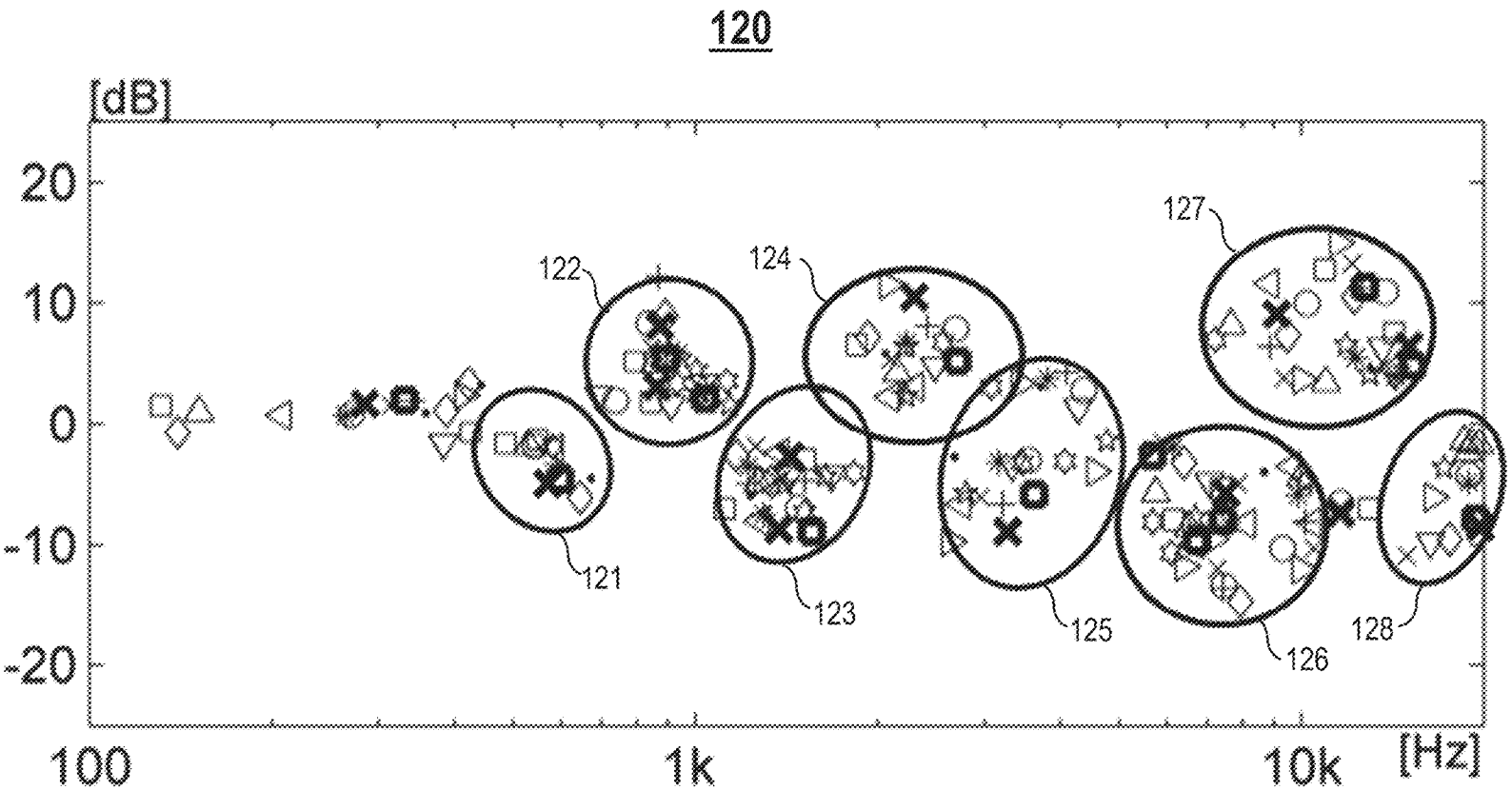
FIG. 10B is an example graph illustrating grouping of data points representing gains and frequencies of multiple PEQs, in accordance with an embodiment.

FIG. 10B is an example graph 120 illustrating grouping of data points representing gains and frequencies of multiple PEQs, in accordance with an embodiment. A horizontal axis of the graph 120 represents frequency in Hz. A vertical axis of the graph 120 represents gain in dB. The graph 120 comprises the same sets of data points as those illustrated in the graph 110 of FIG. 10A. As shown in FIG. 10B, the sets of data points are grouped into different groups, wherein each group comprises multiple data points corresponding to common PEQs for different test subjects but with similar gains. For example, as shown in FIG. 10B, the graph 120 comprises each of the following groups: (1) a first group 121 of PEQs with similar negative gains, (2) a second group 122 of PEQs with similar positive gains, (3) a third group 123 of PEQs with similar negative gains, (4) a fourth group 124 of PEQs with similar positive gains, (5) a fifth group 125 of PEQs with similar gains, (6) a sixth group 126 of PEQs with similar negative gains, (7) a seventh group 127 of PEQs with similar positive gains, and (8) an eighth group 128 of PEQs with similar negative gains.

Figure 10C:
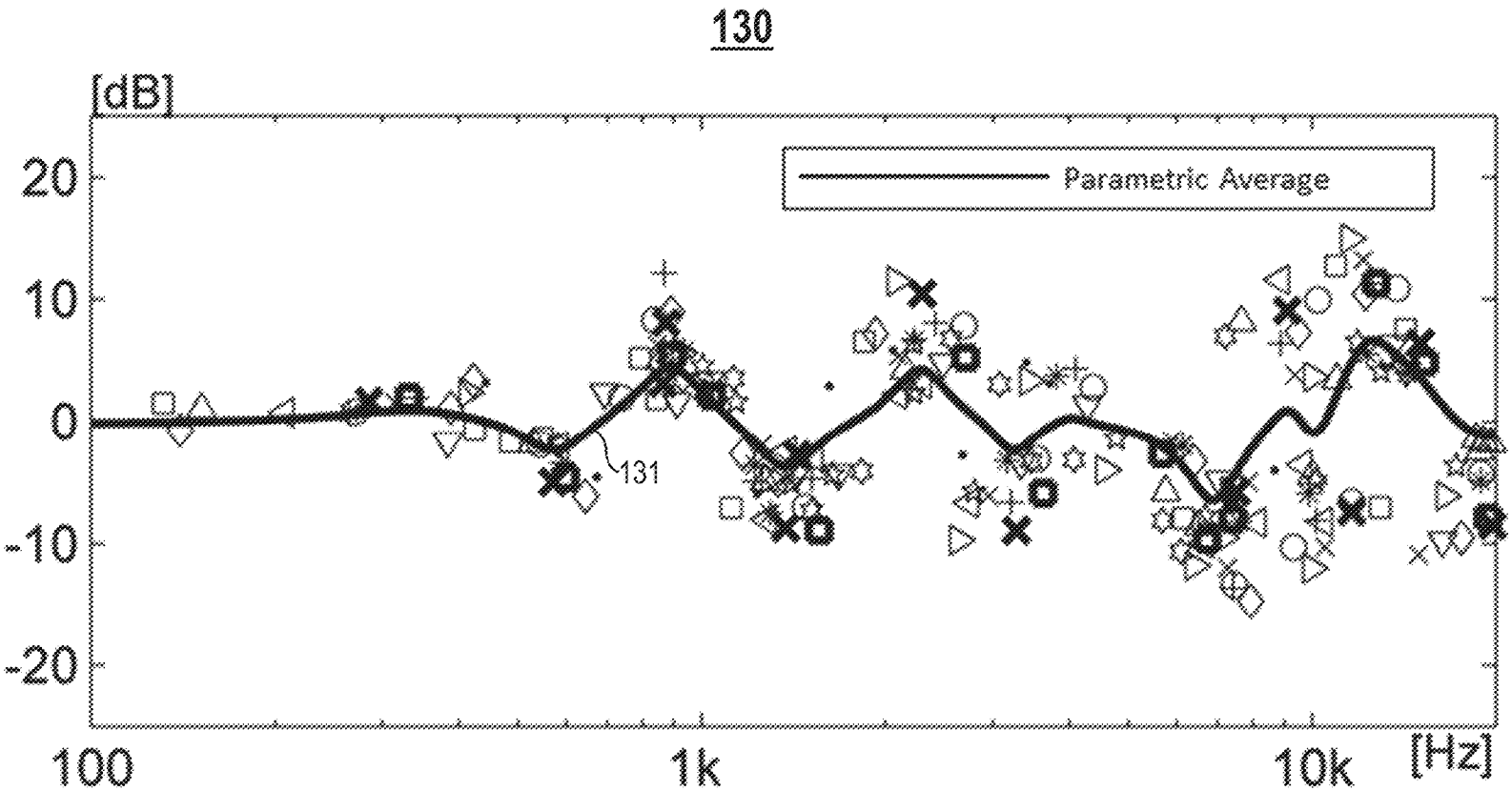
FIG. 10C is an example graph illustrating an example parametric average of multiple individual de-elevation filters for multiple test subjects, in accordance with an embodiment.

FIG. 10C is an example graph 130 illustrating an example parametric average of multiple individual de-elevation filters for multiple test subjects referenced in the SAL database, in accordance with an embodiment. A horizontal axis of the graph 130 represents frequency in Hz. A vertical axis of the graph 130 represents gain in dB. The graph 130 comprises the same sets of data points as those illustrated in the graphs 110-120 of FIGS. 10A-10B. The graph 130 comprises a first curve 131 representing the parametric average of the multiple individual de-elevation filters. The parametric average represents a universal average de-elevation filter across the multiple test subjects, wherein the parametric average is obtained by averaging parametric values of PEQs characterizing the multiple individual de-elevation filters.

In one embodiment, the filter design unit 320 is configured to: (1) identify groups of common PEQs with similar gains (e.g., groups 121-128 in FIG. 10B) based on parametric information maintained for each test subject (i.e., parametric information characterizing an individual filter for the test subject), (2) for each group identified, determining average parametric values of the group (e.g., an average frequency, an average gain, an average Q), and (3) constructing a universal average filter representing a parametric average across the test subjects based on average parametric values determined for each group.

Figure 10D:
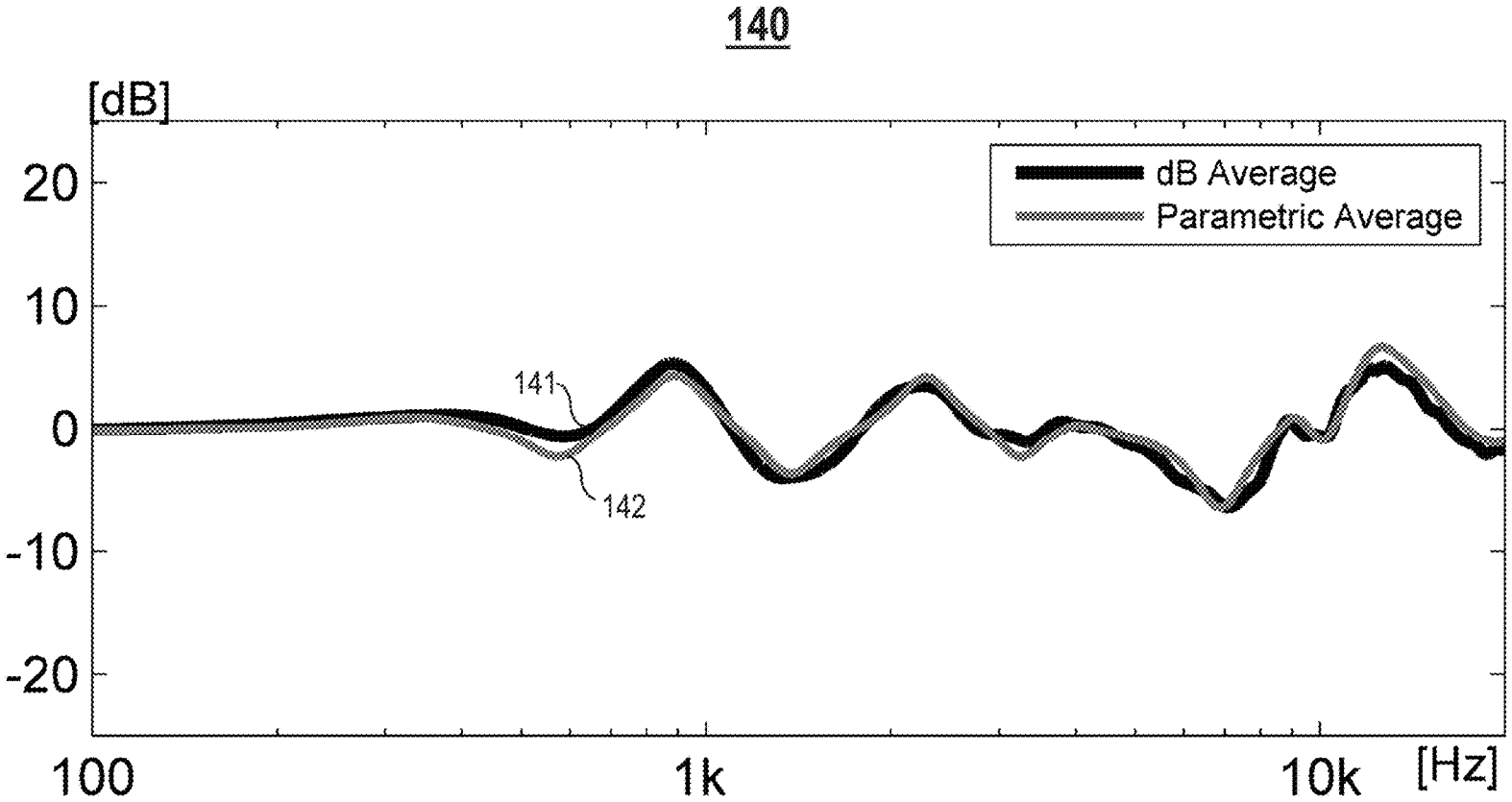
FIG. 10D is an example graph illustrating both a parametric average of multiple individual de-elevation filters corresponding to multiple test subjects and a dB average of the filters, in accordance with an embodiment.

FIG. 10D is an example graph 140 illustrating both a parametric average of multiple individual de-elevation filters corresponding to multiple test subjects referenced in the SAL database and a dB average of the filters, in accordance with an embodiment. A horizontal axis of the graph 140 represents frequency in Hz. A vertical axis of the graph 140 represents gain in dB. The graph 140 comprises each of the following: (1) a first curve 141 representing the parametric average of the multiple individual de-elevation filters, wherein the curve 141 is the same as the curve 131 illustrated in the graph 130 of FIG. 10C, and (2) a second curve 142 representing the dB average of the multiple individual de-elevation filters. Compared to the dB average, the parametric average is more effective for more test subjects.

In one embodiment, to create an optimal digital filter that increases or maximizes accuracy in apparent elevation change for as many human subjects as possible and that reduces or minimizes spectral coloration, a subjective evaluation with human subjects is performed. The filter optimization unit 330 is configured to optimize a universal average filter generated by the filter design unit 320 based on evaluation data collected during a subjective evaluation with human subjects involving the universal average filter.

In one example implementation, the subjective evaluation performed is divided into at least the following stages: (1) a first stage involving a first determination of gains of PEQs at which human subjects perceive a desired elevation with lowest spectral coloration, and (2) a second stage involving a second determination of an optimal number of biquads necessary for elevation change. Each stage involves presenting to a number of human subjects audio test material reproduced by a sound source with an actual sound source location that is raised (i.e., the sound source is physically raised, e.g., $\phi_{actual}=30°$). The audio test material may comprise any type of audio sample such as, but not limited to, white noise, a female voice, a male voice, etc. The audio test material is filtered utilizing a universal average filter generated by the filter design unit 320 and based on multiple individual filters, wherein each individual filter is set to account for the raised actual sound source location. For example, the universal average filter may be a parametric average of the multiple individual filters.

During each stage, the universal average filter is switched on and off to expose each human subject to one or more changes in an apparent direction of the sound source and spectral coloration.

During the first stage, each human subject has access to a gain of each PEQ that characterizes the universal average filter, thereby allowing the human subject to adjust the gain of the PEQ until the human subject perceives sound source at the desired elevation with lowest spectral coloration. In one embodiment, the first stage is divided into multiple test sessions, wherein a focus of each test session is on two or three PEQs that characterize the universal average filter. During each test session, a human subject may provide input (e.g., via one or more input/output devices connected to the filter design and test system 300) indicative of one or more adjustments to a gain of a PEQ that is the focus of the test session. For example, the human subject may adjust a slider that corresponds to the gain of the PEQ until the human subject perceives the sound source at the desired elevation with lowest spectral coloration.

During the second stage, each human subject has access to switching on or off individual PEQs that characterize the universal average filter. The human subject may provide input (e.g., via one or more input/output devices connected to the filter design and test system 300) indicative of a perceived elevation/location of a sound source in response to switching on or off an individual PEQ, thereby allowing determination of whether the individual PEQ is necessary to allow the human subject to perceive sound source at the desired elevation. An optimal number of biquads necessary for de-elevation/elevation could comprise only individual PEQs that are necessary for allowing a human subject to perceive the desired elevation.

In one embodiment, the filter optimization unit 330 is configured to generate an optimal digital filter 230 that increases or maximizes accuracy in apparent elevation change for as many human subjects as possible and reduces or minimizes spectral coloration based on each determination made during each stage of a subjective evaluation performed with human subjects.

Figure 11:
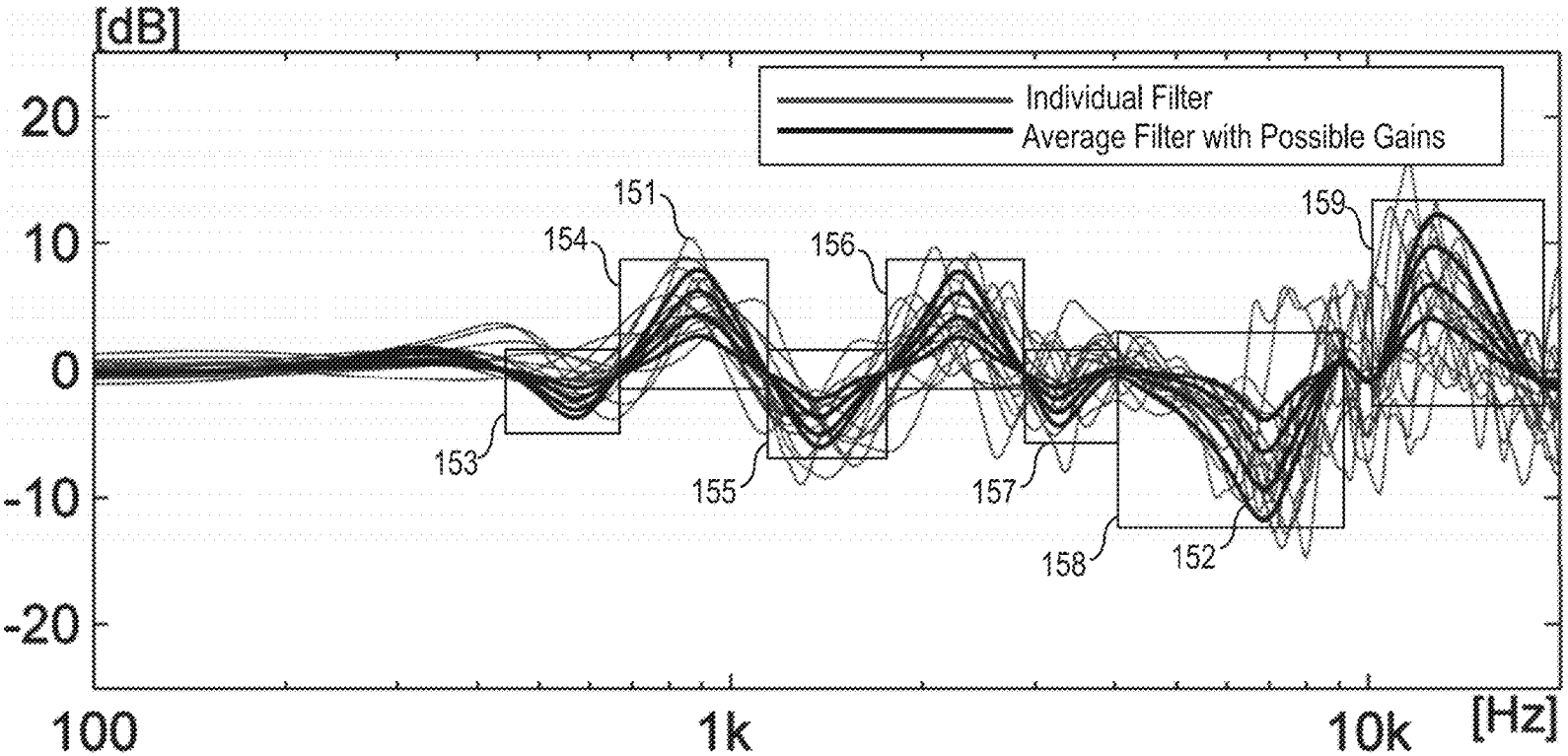
FIG. 11 is an example graph illustrating an example filter optimization process, in accordance with an embodiment.

FIG. 11 is an example graph 150 illustrating an example filter optimization process, in accordance with an embodiment. A horizontal axis of the graph 150 represents frequency in Hz. A vertical axis of the graph 150 represents gain in dB. The graph 150 comprises each of the following: (1) multiple gray curves 151, wherein each gray curve 151 represents an individual de-elevation filter corresponding to a human subject, and (2) multiple black curves 152, wherein each black curve 152 represents a universal average filter (i.e., a parametric average or a dB average of the multiple individual de-elevation filters) with possible gains, and the possible gains are based on evaluation data collected during a subjective evaluation performed, as described above.

Each individual PEQ that characterizes the universal average filter has a corresponding set of possible gains representing adjustments to a gain of the PEQ that human subjects made during the subjective evaluation. For example, as shown in FIG. 11, a first PEQ has a first set 153 of possible gains, a second PEQ has a second set 154 of possible gains, a third PEQ has a third set 155 of possible gains, a fourth PEQ has a fourth set 156 of possible gains, a fifth PEQ has a fifth set 157 of possible gains, a sixth PEQ has a sixth set 158 of possible gains, and a seventh PEQ has a seventh set 159 of possible gains.

Figure 12:
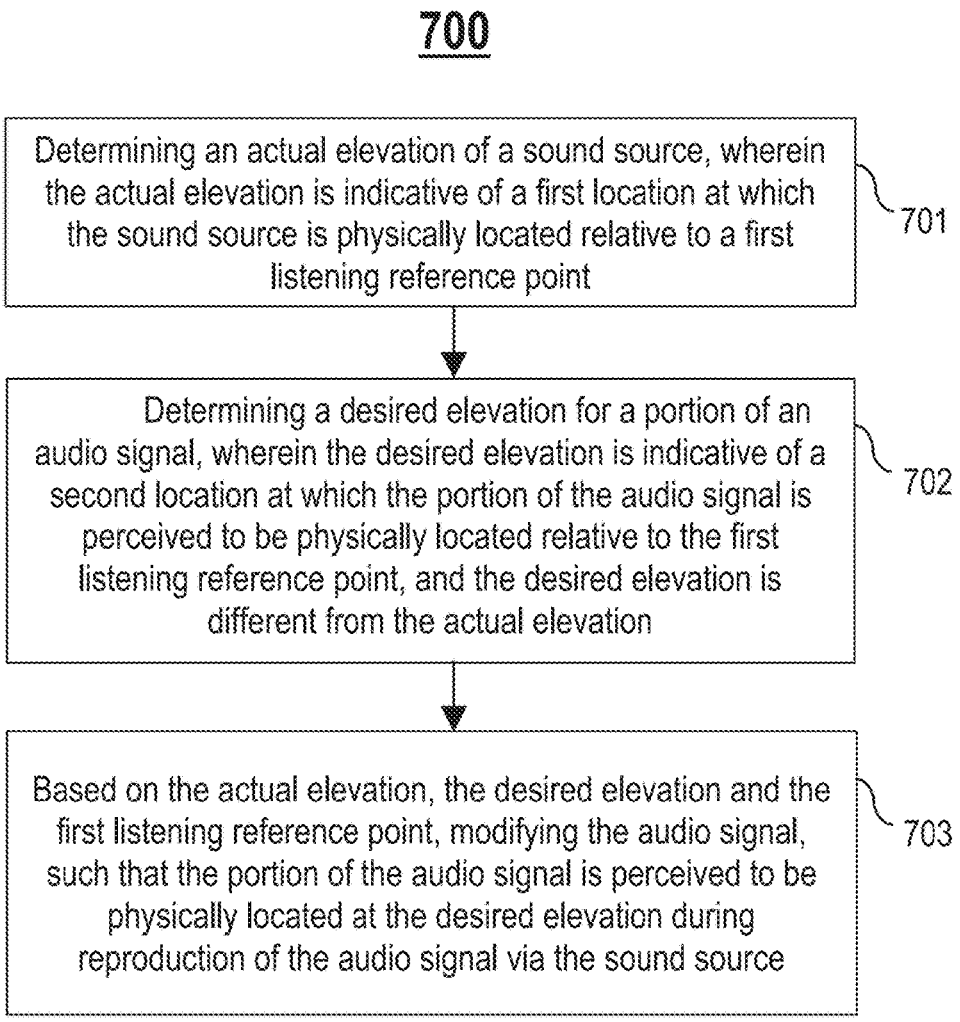
FIG. 12 is an example flowchart of a process for modifying an apparent elevation of a sound source, in accordance with an embodiment.

FIG. 12 is an example flowchart of a process 700 for modifying an apparent elevation of a sound source, in accordance with an embodiment. Process block 701 includes determining an actual elevation of a sound source (e.g., a loudspeaker), wherein the actual elevation is indicative of a first location at which the sound source is physically located relative to a first listening reference point (e.g., a human subject). Process block 702 includes determining a desired elevation for a portion of an audio signal, wherein the desired elevation is indicative of a second location at which the portion of the audio signal is perceived to be physically located relative to the first listening reference point, and the desired elevation is different from the actual elevation. Process block 703 includes, based on the actual elevation, the desired elevation and the first listening reference point, modifying the audio signal, such that the portion of the audio signal is perceived to be physically located at the desired elevation during reproduction of the audio signal via the sound source.

In one embodiment, one or more components of the loudspeaker system 200 (e.g., the filter system 220) and/or the filter design and test system 300 (e.g., the filter design unit 320, the filter optimization unit 330) are configured to perform process blocks 701-703.

Figure 13:
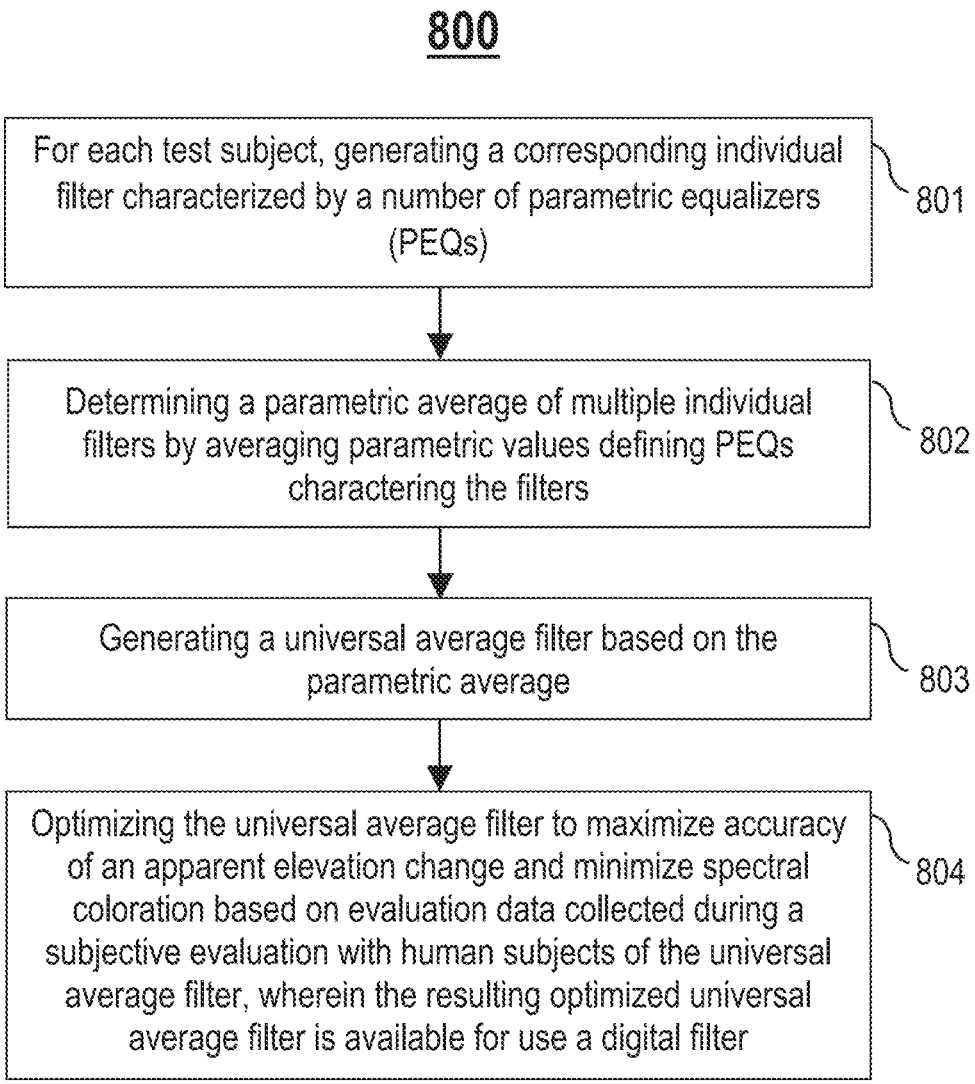
FIG. 13 is an example flowchart of a process for generating a digital filter, in accordance with an embodiment.

FIG. 13 is an example flowchart of a process 800 for generating a digital filter, in accordance with an embodiment. Process block 801 includes, for each test subject, generating a corresponding individual filter characterized by a number of parametric equalizers (PEQs). Process block 802 includes determining a parametric average of multiple individual filters by averaging parametric values defining PEQs charactering the filters. Process block 803 includes generating a universal average filter based on the parametric average. Process block 804 includes optimizing the universal average filter to maximize accuracy of an apparent elevation change and minimize spectral coloration based on evaluation data collected during a subjective evaluation with human subjects of the universal average filter, wherein the resulting optimized universal average filter is available for use a digital filter.

In one embodiment, one or more components of filter design and test system 300 (e.g., the filter design unit 320, the filter optimization unit 330) are configured to perform process blocks 801-804.

Figure 14:
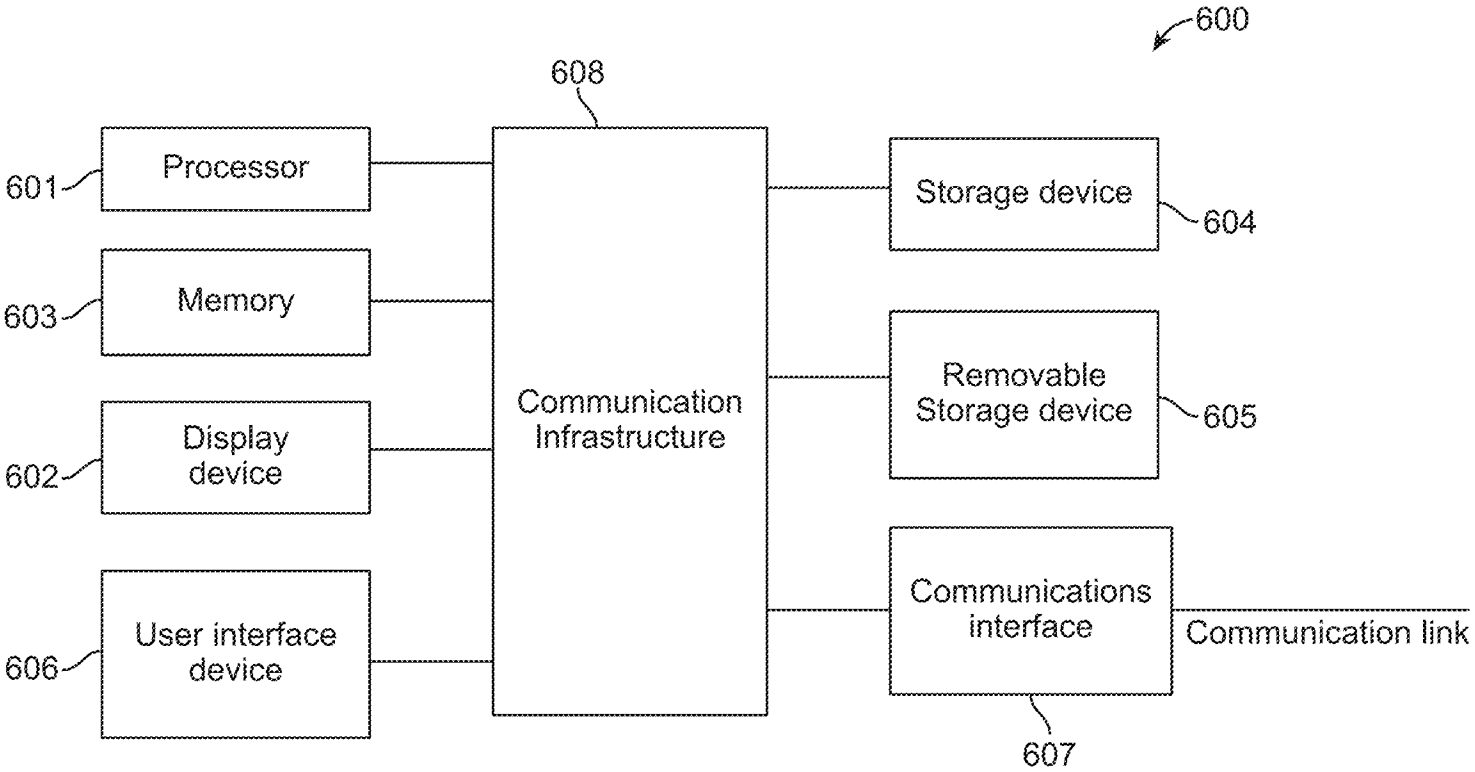
FIG. 14 is a high-level block diagram showing an information processing system comprising a computer system useful for implementing various disclosed embodiments.

FIG. 14 is a high-level block diagram showing an information processing system comprising a computer system 600 useful for implementing various disclosed embodiments. The computer system 600 includes one or more processors 601, and can further include an electronic display device 602 (for displaying video, graphics, text, and other data), a main memory 603 (e.g., random access memory (RAM)), storage device 604 (e.g., hard disk drive), removable storage device 605 (e.g., removable storage drive, removable memory module, a magnetic tape drive, optical disk drive, computer readable medium having stored therein computer software and/or data), user interface device 606

(e.g., keyboard, touch screen, keypad, pointing device), and a communication interface 607 (e.g., modem, a network interface (such as an Ethernet card), a communications port, or a PCMCIA slot and card).

The communications interface 607 allows software and data to be transferred between the computer system 600 and external devices. The nonlinear controller 600 further includes a communications infrastructure 608 (e.g., a communications bus, cross-over bar, or network) to which the aforementioned devices/modules 601 through 607 are connected.

Information transferred via the communications interface 607 may be in the form of signals such as electronic, electromagnetic, optical, or other signals capable of being received by communications interface 607, via a communication link that carries signals and may be implemented using wire or cable, fiber optics, a phone line, a cellular phone link, a radio frequency (RF) link, and/or other communication channels. Computer program instructions representing the block diagrams and/or flowcharts herein may be loaded onto a computer, programmable data processing apparatus, or processing devices to cause a series of operations performed thereon to produce a computer implemented process. In one embodiment, processing instructions for process 700 (FIG. 12) and process 800 (FIG. 13) may be stored as program instructions on the memory 603, storage device 604, and/or the removable storage device 605 for execution by the processor 601.

Embodiments have been described with reference to flowchart illustrations and/or block diagrams of methods, apparatus (systems), and computer program products. In some cases, each block of such illustrations/diagrams, or combinations thereof, can be implemented by computer program instructions. The computer program instructions when provided to a processor produce a machine, such that the instructions, which executed via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium," and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatuses, or other devices to function in a particular manner, such that the instructions stored in the computer readable medium produce an article of manufacture including instructions which implement the function/act specified in the flowchart and/or block diagram block(s).

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium (e.g., a non-transitory computer readable medium). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++, or the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

In some cases, aspects of one or more embodiments are described above with reference to flowchart illustrations and/or block diagrams of methods, apparatuses (systems), and computer program products. In some instances, it will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block(s).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block(s).

The computer program instructions may also be loaded onto a computer, other programmable data processing apparatuses, or other devices to cause a series of operational steps to be performed on the computer, other programmable apparatuses, or other devices to produce a computer implemented process such that the instructions which execute on the computer or other programmable apparatuses provide processes for implementing the functions/acts specified in the flowchart and/or block diagram block(s).

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A method comprising:

determining an actual elevation of a sound source, wherein the actual elevation is indicative of a first location at which the sound source is physically located relative to a first listening reference point;

determining a desired elevation for a portion of an audio signal, wherein the desired elevation is indicative of a second location at which the portion of the audio signal is perceived to be physically located relative to the first listening reference point, and the desired elevation is different from the actual elevation; and based on the actual elevation, the desired elevation, and the first listening reference point, modifying the audio signal by:

generating a digital filter based on information relating to different individual filters, wherein the information relating to different individual filters comprises parametric values defining a number of parametric equalizers (PEQs) that characterize the different individual filters based on Head-Related Transfer Functions (HRTFs) corresponding to the actual elevation and the desired elevation; and filtering the portion of the audio signal during the reproduction of the audio signal via the digital filter that increases accuracy in apparent elevation change and reduces spectral coloration, such that the portion of the audio signal is perceived to be physically located at the desired elevation during reproduction of the audio signal via the sound source.

2. The method of claim 1, wherein the information relating to different individual filters comprises information relating to different individual filters for different individuals.

3. The method of claim 1, wherein generating the digital filter comprises:

determining a parametric average of the different individual filters by averaging the parametric values, wherein the digital filter is generated in accordance with the parametric average.

4. The method of claim 1, further comprising:

optimizing the digital filter to maximize the accuracy in apparent elevation change and minimize the spectral coloration based on evaluation data collected during a subjective evaluation with human subjects involving the digital filter.

5. The method of claim 1, wherein the desired elevation is above the actual elevation, and the digital filter is an elevation filter configured to elevate a perceived physical location of the portion of the audio signal from the actual elevation to the desired elevation.

6. The method of claim 1, wherein the desired elevation is below the actual elevation, and the digital filter is a de-elevation filter configured to de-elevate a perceived physical location of the portion of the audio signal from the actual elevation to the desired elevation.

7. The method of claim 1, wherein the digital filter is one of an infinite impulse response (IIR) filter or a finite impulse response (FIR) filter.

8. The method of claim 1, wherein the digital filter comprises a set of second-order sections in cascade.

9. A system comprising:

at least one processor; and a non-transitory processor-readable memory device storing instructions that when executed by the at least one processor causes the at least one processor to perform operations including:

determining an actual elevation of a sound source, wherein the actual elevation is indicative of a first location at which the sound source is physically located relative to a first listening reference point;

determining a desired elevation for a portion of an audio signal, wherein the desired elevation is indicative of a second location at which the portion of the audio signal is perceived to be physically located relative to the first listening reference point, and the desired elevation is different from the actual elevation; and based on the actual elevation, the desired elevation, and the first listening reference point, modifying the audio signal by:

generating a digital filter based on information relating to different individual filters, wherein the information relating to different individual filters comprises parametric values defining a number of parametric equalizers (PEQs) that characterize the different individual filters based on Head-Related Transfer Functions (HRTFs) corresponding to the actual elevation and the desired elevation; and filtering the portion of the audio signal during the reproduction of the audio signal via the digital filter that increases accuracy in apparent elevation change and reduces spectral coloration, such that the portion of the audio signal is perceived to be physically located at the desired elevation during reproduction of the audio signal via the sound source.

10. The system of claim 9, wherein the information relating to different individual filters comprises information relating to different individual filters for different individuals.

11. The system of claim 9, wherein generating the digital filter comprises:

determining a parametric average of the different individual filters by averaging the parametric values, wherein the digital filter is generated in accordance with the parametric average.

12. The system of claim 9, wherein the operations further comprise:

optimizing the digital filter to maximize the accuracy in apparent elevation change and minimize the spectral coloration based on evaluation data collected during a subjective evaluation with human subjects involving the digital filter.

13. The system of claim 9, wherein the desired elevation is above the actual elevation, and the digital filter is an elevation filter configured to elevate a perceived physical location of the portion of the audio signal from the actual elevation to the desired elevation.

14. The system of claim 9, wherein the desired elevation is below the actual elevation, and the digital filter is a de-elevation filter configured to de-elevate a perceived physical location of the portion of the audio signal from the actual elevation to the desired elevation.

15. The system of claim 9, wherein the digital filter is one of an infinite impulse response (IIR) filter or a finite impulse response (FIR) filter.

16. The system of claim 9, wherein the digital filter comprises a set of second-order sections in cascade.

17. A non-transitory computer-readable medium having instructions which when executed on a computer perform a method comprising:

determining an actual elevation of a sound source, wherein the actual elevation is indicative of a first location at which the sound source is physically located relative to a first listening reference point;

determining a desired elevation for a portion of an audio signal, wherein the desired elevation is indicative of a second location at which the portion of the audio signal is perceived to be physically located relative to the first listening reference point, and the desired elevation is different from the actual elevation; and based on the actual elevation, the desired elevation, and the first listening reference point, modifying the audio signal by:

generating a digital filter based on information relating to different individual filters, wherein the information relating to different individual filters comprises parametric values defining a number of parametric equalizers (PEQs) that characterize the different individual filters based on Head-Related Transfer Functions (HRTFs) corresponding to the actual elevation and the desired elevation; and filtering the portion of the audio signal during the reproduction of the audio signal via the digital filter that increases accuracy in apparent elevation change and reduces spectral coloration, such that the portion of the audio signal is perceived to be physically located at the desired elevation during reproduction of the audio signal via the sound source.

18. The non-transitory computer-readable medium of claim 17, wherein:

the information relating to different individual filters comprises information relating to different individual filters for different individuals; and the method further comprises optimizing the digital filter to maximize the accuracy in apparent elevation change and minimize the spectral coloration based on evaluation data collected during a subjective evaluation with human subjects involving the digital filter.

* * * * *